US009232831B2

(12) United States Patent
Kimura et al.

(10) Patent No.: US 9,232,831 B2
(45) Date of Patent: Jan. 12, 2016

(54) HEEL COUNTER STRUCTURE FOR A SHOE

(75) Inventors: Takaya Kimura, Nishinomiya (JP); Tatsuya Dazai, Nishinomiya (JP); Takao Oda, Takarazuka (JP)

(73) Assignee: Mizuno Corporation, Osaka-shi (JP)

( * ) Notice: Subject to any disclaimer, the term of this patent is extended or adjusted under 35 U.S.C. 154(b) by 689 days.

(21) Appl. No.: 13/479,725

(22) Filed: May 24, 2012

(65) Prior Publication Data

US 2012/0304491 A1 Dec. 6, 2012

(30) Foreign Application Priority Data

Jun. 1, 2011 (JP) ..... 2011-123353

(51) Int. Cl.

| | |
|---|---|
| ***A43B 23/08*** | (2006.01) |
| ***A43B 23/02*** | (2006.01) |
| ***A43B 7/20*** | (2006.01) |
| *A43B 7/14* | (2006.01) |

(52) U.S. Cl.

CPC ..... *A43B 23/027* (2013.01); *A43B 7/20* (2013.01); *A43B 23/087* (2013.01); *A43B 23/088* (2013.01); *A43B 7/144* (2013.01)

(58) Field of Classification Search

CPC .... A43B 23/08; A43B 23/027; A43B 23/088; A43B 23/087; A43B 23/10; A43B 23/105; A43B 23/14; A43B 7/144; A43B 7/20

USPC ..... 36/88, 89, 92, 102, 72 B, 69, 58.6

See application file for complete search history.

(56) References Cited

U.S. PATENT DOCUMENTS

| | | | | |
|---|---|---|---|---|
| 912,579 | A * | 2/1909 | Krech et al. | 36/58.5 |
| 1,176,198 | A * | 3/1916 | Britts | 36/68 |
| 4,670,998 | A * | 6/1987 | Pasternak | 36/114 |
| 5,056,509 | A * | 10/1991 | Swearington | 602/29 |
| 5,317,820 | A * | 6/1994 | Bell et al. | 36/89 |
| 6,079,128 | A * | 6/2000 | Hoshizaki et al. | 36/89 |
| 7,204,043 | B2 * | 4/2007 | Kilgore | 36/68 |

(Continued)

FOREIGN PATENT DOCUMENTS

| | | |
|---|---|---|
| EP | 0 350 784 | 1/1990 |
| JP | 06-284907 A | 10/1994 |

(Continued)

OTHER PUBLICATIONS

Japanese Office Action in Japanese Patent Application No. 2011-123353, mailed Aug. 5, 2013, 2 pages, with partial English translation, 1 page.

*Primary Examiner* — Jila M Mohandesi
(74) *Attorney, Agent, or Firm* — W. F. Fasse

(57) ABSTRACT

The heel counter structure includes a sole plate provided at least at the heel region of the shoe and having a peripheral portion. The peripheral portion is upraised along the heel region of the shoe so as to enclose the lower portion of the heel portion of the foot of the wearer. The heel structure also includes a pair of heel counter portions provided on the medial and lateral sides of the heel region of the shoe so as to sandwich the heel portion of the foot sideways. The heel counter portions are coupled to the peripheral portion of the sole plate at the lower ends of the heel counter portions so that the heel counter portions can tilt inwardly and outwardly independently of the sole plate. The heel counter portions are separated from the peripheral portion of the sole plate except the lower ends of the heel counter portions.

19 Claims, 39 Drawing Sheets

(56) References Cited

U.S. PATENT DOCUMENTS

| | | | | |
|---|---|---|---|---|
| 7,219,450 | B2 * | 5/2007 | Langley | 36/89 |
| 8,020,317 | B1 * | 9/2011 | Sokolowski | 36/69 |
| 8,215,036 | B2 * | 7/2012 | Auger et al. | 36/69 |
| 8,590,178 | B2 * | 11/2013 | Avar et al. | 36/89 |
| 2011/0185592 | A1 | 8/2011 | Nishiwaki et al. | |

FOREIGN PATENT DOCUMENTS

| | | |
|---|---|---|
| JP | 07-036481 | 8/1995 |
| WO | WO 2010/038267 | 4/2010 |

* cited by examiner

HEEL COUNTER STRUCTURE FOR A SHOE

BACKGROUND OF THE INVENTION

The present invention relates generally to a heel counter structure for a shoe, and more particularly, to improvement in structure to hold a heel of a foot of a shoe wearer stably at all times irrespective of width of the heel or size of calcaneus of the foot.

The applicant of the present invent ion proposed a sole structure for an athletic sports shoe in which a sole has a three-dimensional upraised shape to enclose a region extending from a ball of a foot in front of a plantar arch portion to a heel portion and an upper end edge portion of the upraised shape extends to a vicinity of a ridge line of the widest region of the foot (see figured 1 and 3 of Japanese utility model registration application examined publication No. H07-36481 or 1995-36481).

In this case, giving a three-dimensional shape to the sole allows for secure support of the heel without a heel counter for holding the heel.

However, in the structure shown in the above-mentioned publication, since an upraised portion whose upper end edge portion extends to the vicinity of the ridge line of the widest region of the foot is adapted to hold an entire heel, in the event that a width of the sole of the shoe corresponds to a heel width of the foot of a wearer, it can hold the heel sufficiently, but in the event that the heel width of the foot is smaller than the width of the sole of the shoe, a gap is created between the heel and the shoe and thus it cannot hold the heel sufficiently thereby causing support of the heel to be unstable. To the contrary, in the event that the heel width of the foot is greater than the width of the sole of the shoe, the heel of the foot steps on the upraised portion to deform an upper part of the upraised portion outwardly. Thereby, the structure cannot hold the heel sufficiently, shortens the life of the shoe, and causes sore of the foot through chafing of the shoe.

Another prior-art heel counter structure is shown in FIG. 37. As shown in FIG. 37, the heel counter structure 100 includes a planar insole board 101 and a heel counter portion 102 disposed along a heel peripheral portion of the insole board 101 to enclose a heel of a foot.

In this case as well, in the event that a heel width of the foot F of a wearer corresponds to a heel width of the shoe (see FIG. 38), the heel counter portion 102 can hold the heel, but in the event that the heel width of the foot F is greater than the heel width of the shoe (see FIG. 39), since the heel of the foot F widens and deforms an upper part of the heel counter portion 102 outwardly, the heel counter portion 102 cannot hold the heel sufficiently (see FIG. 39 and a dash-and-dot line of FIG. 37). Also, in the event that the heel width of the foot is smaller than the heel width of the shoe, a gap is created between the heel and the shoe and thus it cannot hold the heel sufficiently either.

On the other hand, it is considered that not only for shoe length but also for heel width of a shoe, different sized shoes are prepared and stocked, but it is not realistic to stock shoes of different heel widths respectively for the shoes of different lengths because shoe manufacturers and shoe sales divisions need to have a large stock of shoes.

The present invention has been made in view of these circumstances and its object is to provide a heel counter structure for a shoe that can hold a heel of a foot of a shoe wearer stably at all times irrespective of width of the heel or size of calcaneus of the foot. In other words, the present invention is directed to providing a heel counter structure for a shoe to increase holdability of a heel of a foot.

Other objects and advantages of the present invention will be obvious and appear hereinafter.

SUMMARY OF THE INVENTION

A heel counter structure for a shoe according to the present invention includes a sole plate that is provided at least at a heel region of the shoe and that has a peripheral portion upraised along the heel region of the shoe so as to enclose a lower portion of a heel portion of a foot of a shoe wearer, and a pair of heel counter portions provided on a medial side and a lateral side of the heel region of the shoe respectively so as to sandwich the heel portion of the foot sideways. The heel counter portions are coupled to the peripheral portion of the sole plate at lower ends of the heel counter portions so that the heel counter portions can tilt inwardly and outwardly independently of the sole plate.

According to the present invention, when wearing the shoe, the lower portion of the heel portion of the foot is held by the peripheral portion of the sole plate. Also, at this juncture, the heel portion of the foot is sandwiched sideways by the heel counter portions coupled to the peripheral portion of the sole plate. Thereby, the heel of the foot can be held and supported and fittingness can be improved.

Moreover, since the heel counter portions are coupled to the peripheral portion of the sole plate at lower ends of the heel counter portions so that the heel counter portions can tilt inwardly and outwardly independently of the sole plate, when a heel width of the foot is greater than a width of the sole plate and thus the heel portion of the foot has stepped on and spread out the peripheral portion of the sole plate, the heel counter portions tilt outwardly and thus the heel counter portions can sandwich and hold the heel portion of the foot sideways without leaving the heel portions.

In addition, if the width of the sole plate is designed beforehand so as to fit a foot of a smaller heel width, for a foot of a greater heel width than the width of the sole plate, the heel portions tilt outwardly to hold the heel portion sideways.

In such a manner, the heel counter structure of the present invention can hold the heel of the foot of the shoe wearer stably at all times irrespective of width of the heel or size of calcaneus of the foot. On motion as well as in a state of rest, holdability and fittingness of the heel of the foot can be enhanced.

The sole plate may have a round shape along a shape of a sole of the heel portion of the foot. That is, in this case, the sole plate has a three-dimensional shape, not a plane two-dimensional shape, that contours the shape of the sole of the foot. Generally, a human foot has corpus adiposum below a calcaneus of the heel portion and a bottom surface of the heel portion is round shaped. Accordingly, if the heel portion steps on a plane soleplate, the bottom surface of the heel portion is deformed into a flat shape, but when the heel portion steps on a round soleplate, the bottom surface of the heel portion maintains a round shape along the sole plate without being deformed into a flat shape. Thereby, the heel portion of the foot can exhibit cushioning properties that the corpus adiposum used to have, and thickness of a sole of a shoe does not need to be thickened to improve cushioning properties, thus reducing the weight of the entire shoe.

The peripheral portion of the sole plate may have an inverted V-shape such that its height is higher at a central portion of the sole plate at a rear end of the heel region of the shoe and it gradually lowers toward a medial end and a lateral end of the sole plate.

The heel counter portions may be separated from the peripheral portion of the sole plate except the lower ends of the heel counter portions. In this case, inward and outward tilting movement and deformation of the heel counter portions can be smoothly carried out independent of the peripheral portion of the sole plate.

The central portion of the peripheral portion of the inverted V-shape of the sole plate at the rear end of the heel region of the shoe may extend to or in the vicinity of the most protruded portion at the rear end of the heel portion of the foot. In this case, when wearing the shoe, a rear end portion of the heel of the foot is supported by the central portion of the peripheral portion of the inverted V-shape of the sole plate in a longitudinal direction of the shoe and thus a proper position of the foot inside the shoe in the longitudinal direction can be determined.

A starting point of separation of each of the heel counter portions on a rear side thereof from the peripheral portion of the sole plate is disposed downward and rearward from a prominence of the heel portion below a malleolus of the heel portion on the medial side and the lateral side of the foot. In this case, when the heel counter portions are tilted and deformed outwardly around the starting point of separation, the heel counter portions can securely contact the prominence of the heel portion sideways below the malleolus of the heel portion on the medial side and the lateral side of the foot. Thereby, the heel portion can be securely held sideways.

The heel counter portions may be spaced away from the peripheral portion of the inverted V-shape of the sole plate. In this case, inward and outward tilt and deformation movement of the heel counter portions can be carried out smoothly independent of the peripheral portion of the sole plate without interfering with the peripheral portion.

Upper end edges of the heel counter portions may extend to lower portions of malleoli of the heel portion of the foot. Also, each of the heel counter portions may cover the prominence of the heel portion below a malleolus of the heel portion on the medial side and the lateral side of the foot. In these cases, the heel counter portions can hold a large area of the heel portion without impeding the movement of the foot.

Either or both of the heel counter portions may be formed integrally with the sole plate. also, either or both of the heel counter portions may be fixedly attached to the sole plate directly or through another member, which may be an upper for the shoe.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

First Embodiment

Figure 1:
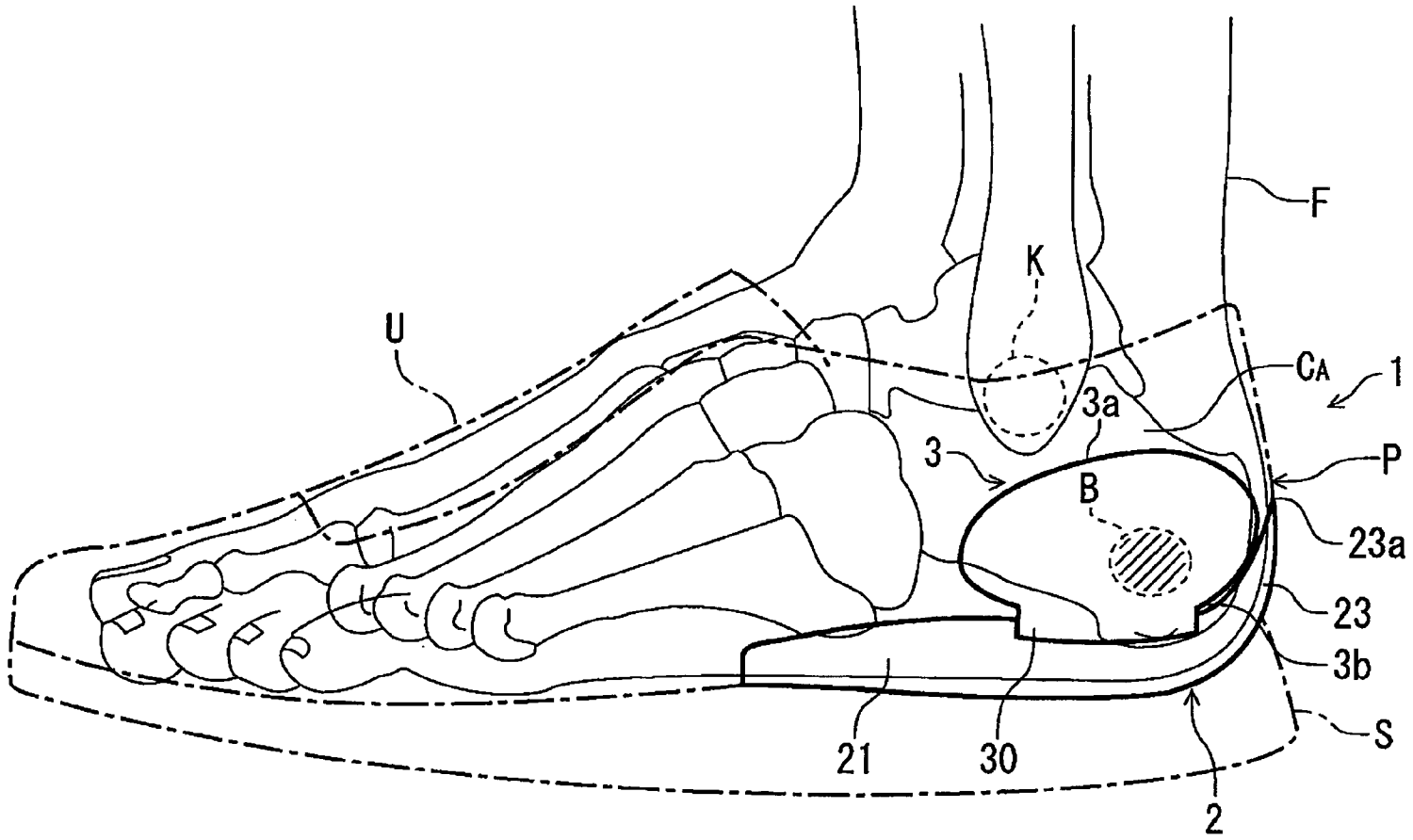
FIG. 1 is a lateral side view of a shoe employing a heel counter structure according to a first embodiment of the present invention, also showing a bone structure of a foot.

Referring now to the drawings, FIGS. 1 to 8 show a heel counter structure for a shoe according to a first embodiment of the present invention. In these drawings, like reference numbers indicate identical or functionally similar elements. In the exemplification, the heel counter structure is applied to a walking shoe or a running shoe. Of course, it also has an application to shoes of different kinds.

Figure 2:
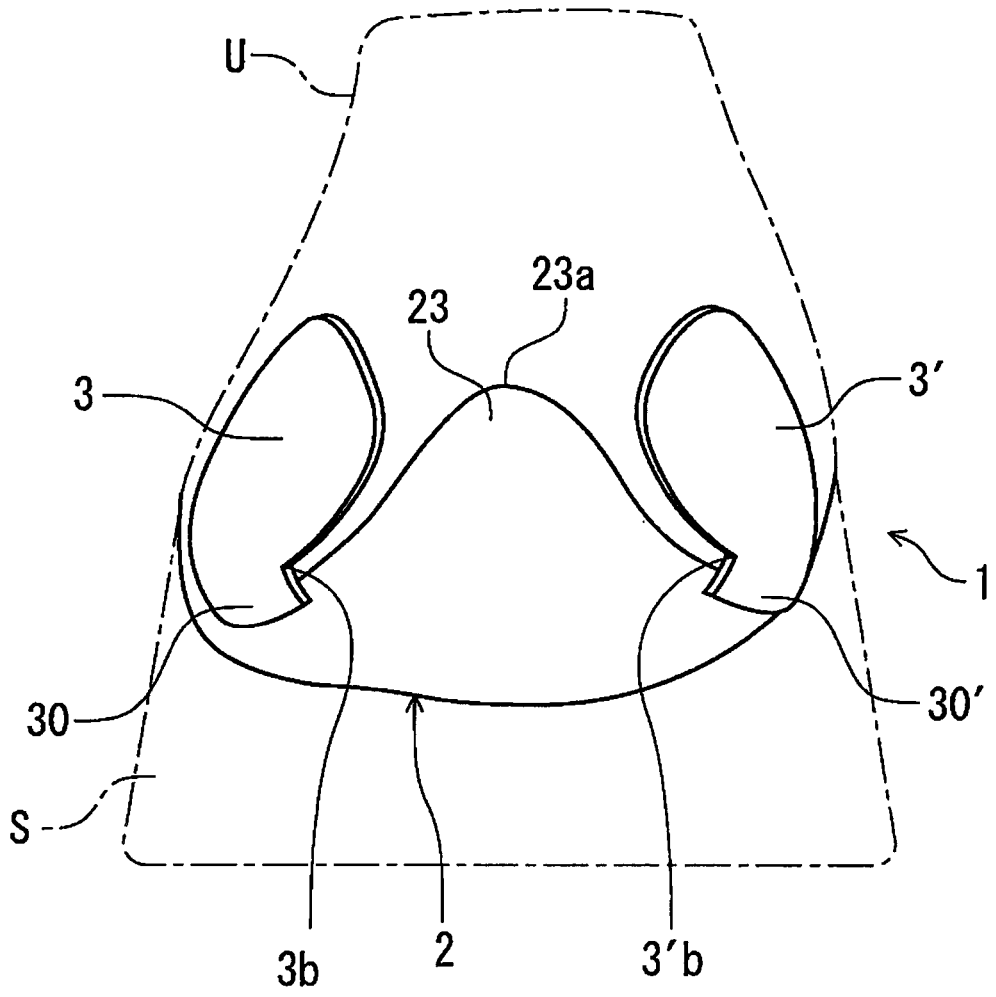
FIG. 2 is a rear side view of the shoe of FIG. 1.

As shown in FIGS. 1 and 2, a shoe includes a sole S and an upper U provided on and fixedly attached to the sole S to cover a foot F of a shoe wearer. A heel counter structure 1 includes a sole plate 2 provided at least at a heel region of the shoe and a pair of heel counter members 3, 3' provided at and extending upwardly from the sole plate 2.

The sole plate 2 in this example extends from a heel rear end to the vicinity of a midfoot region of the shoe. Also, as shown in FIGS. 5 to 8, the sole plate 2 has an insole board 20 and peripheral portions 21, 22, 23 provided along and upraised from an outer circumferential edge portion of the insole board 20 so as to enclose a lower portion of a heel of the foot F, F' of the wearer. The sole plate 2 has a round shape that conforms to a shape of a sole of the heel of the foot F, F'. The peripheral portions 21, 22 are disposed along a lateral side and a medial side of the shoe respectively and the peripheral portion 23 is disposed along the heel rear end of the shoe. The peripheral portions 21, 22, 23 are integrally formed.

Figure 3:
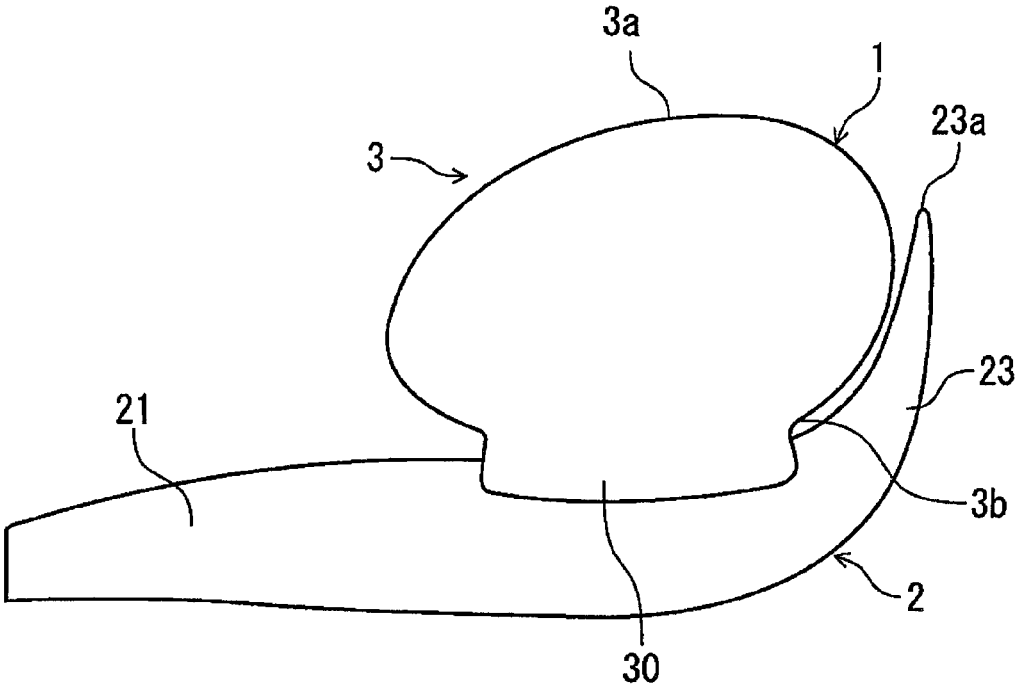
FIG. 3 is a lateral side view of the heel counter structure of FIG. 1.
Figure 4:
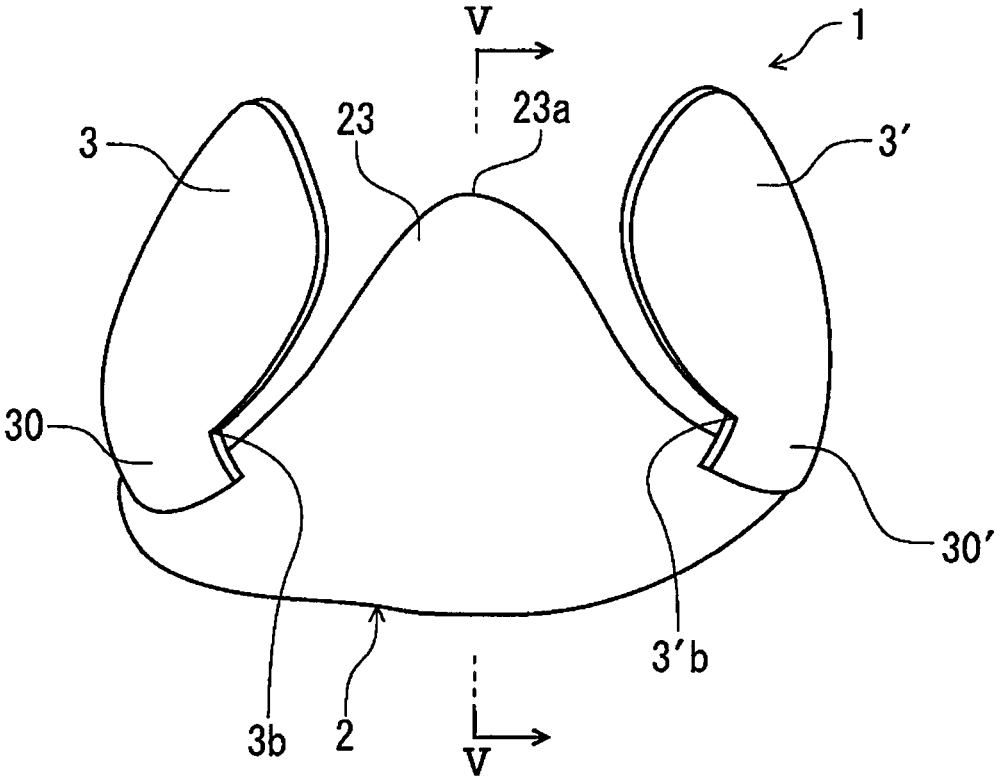
FIG. 4 is a rear side view of the heel counter structure of FIG. 1.
Figure 5:
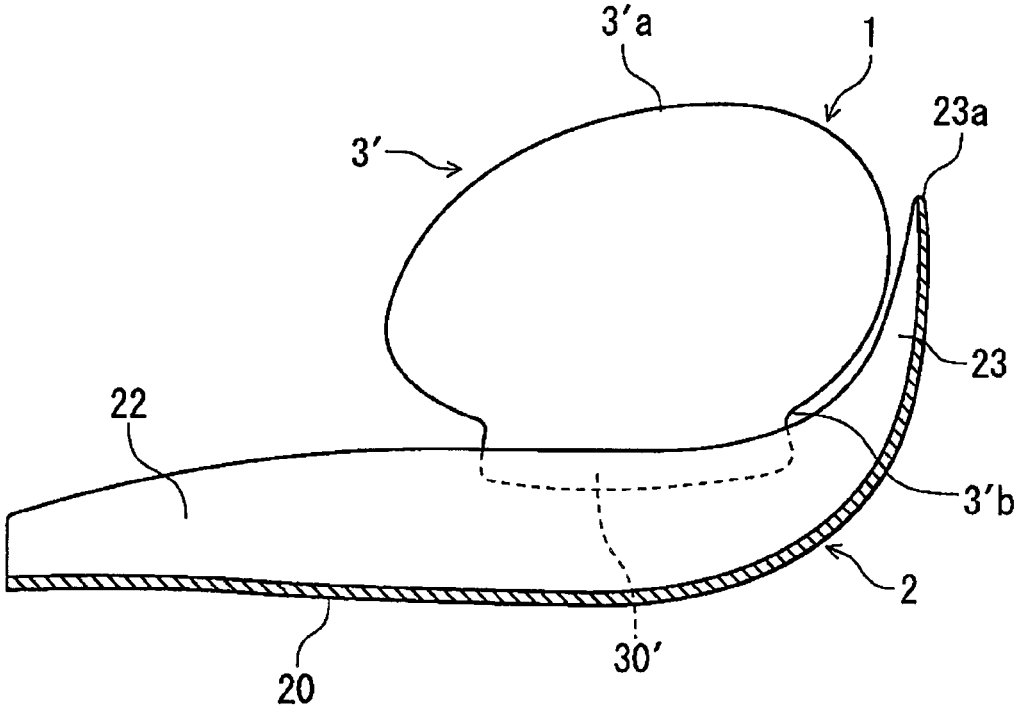
FIG. 5 is a longitudinal sectional view of FIG. 4 taken along line V-V.
Figure 6:
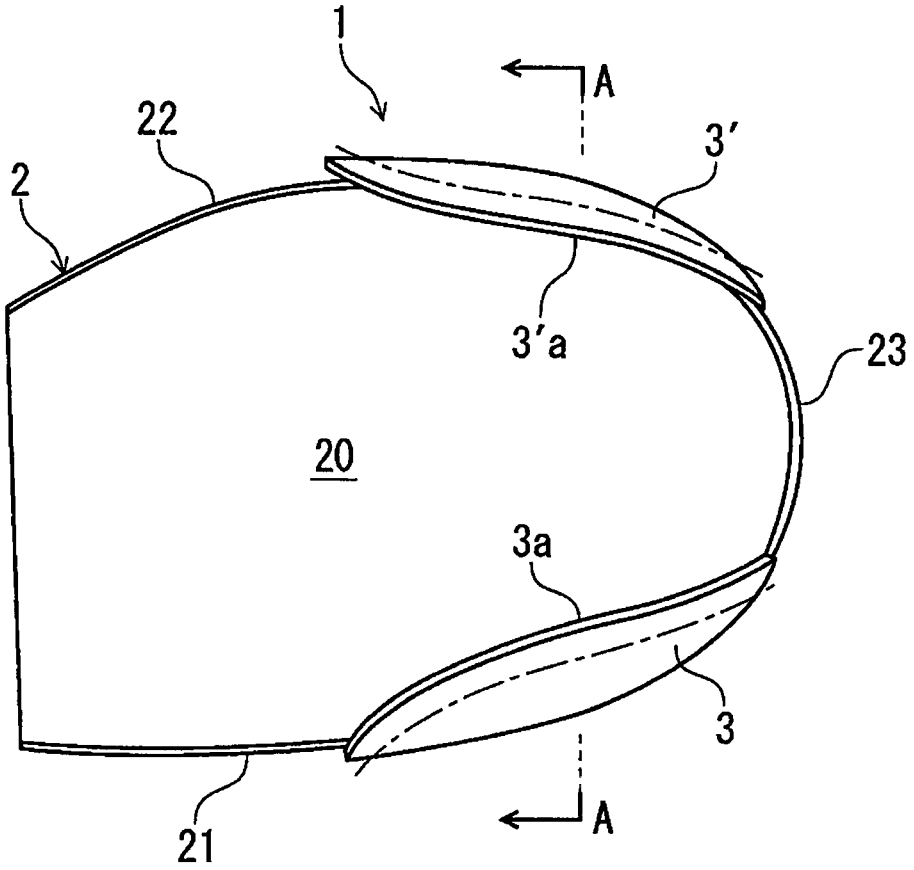
FIG. 6 is a top plan view of the heel counter structure of FIG. 1.

The peripheral portion 23 of the sole plate 2 has a generally inverted V-shape in which its height is higher in the center of the rear end of the heel region of the shoe and it gradually lowers toward a medial side and a lateral side of the rear end of the heel region of the shoe (see FIGS. 2 to 4). As shown in FIG. 1, the uppermost central portion 23*a* of the inverted V-shaped peripheral portion 23 of the sole plate 2 is located at or near the most bulged portion P of the heel rear end of the foot F.

The heel counter members 3, 3' are adapted to sandwich the heel portion of the foot F sideways on the lateral side and the medial side of the heel region of the shoe respectively. More specifically, upper edge portions 3*a*, 3'*a* of the heel counter members 3, 3' extend to the vicinity of lower portions of malleoli of the foot F. That is, the upper edge portion 3*a* of the heel counter member 3 extends to the vicinity of a lower portion of a lateral malleolus K of the foot F (see FIG. 1) and the upper edge portion 3'*a* of the heel counter member 3' extends to the vicinity of a lower portion of a medial malleolus of the foot F (not shown). The heel counter member 3 covers a protruded part B (see a hatched region of FIG. 1) below the lateral malleolus K or a bulge on the lateral side of a calcaneus $C_A$ of the heel portion of the foot F. Similarly, the heel counter member 3' covers a protruded part (not shown) below the medial malleolus or a bulge on the medial side of the calcaneus $C_A$ of the heel portion of the foot F. Each of the heel counter members 3, 3' has a longitudinally elongated shape such as an oval shape, a lenticular shape, an egg-shape or the like as viewed from a side.

A detailed position of a center of the protruded part B below the lateral malleolus or a center of the lateral bulge of the calcaneus $C_A$ of the heel portion of the foot F is shown below. In a longitudinal lengthwise direction, it is located at a position of approximately 17% of a length L of the foot (i.e. 0.17×L) measured longitudinally from the heel rear end of the foot, which corresponds to a position of a center of the heel. Also, in a vertical direction, it is located at a position of (L×0.2778−1.85)/2 [mm] measured upwardly from a top surface of an insole. This is because the lateral malleolus is generally located at a position of (L×0.2778−1.85) [mm], and when considering the fact that if the upper edge portion of the heel counter member contacts the heel portion of the foot, a sore of the foot tends to occur through chafing of the shoe, and thus a central position of the heel counter member should be at a position of a half height relative to a height of the lateral malleolus.

Lower ends of the heel counter members 3, 3' are coupled to the peripheral portions 21, 22 of the sole plate 2 respectively such that the heel counter members 3, 3' can be tilted and deformed inwardly and outwardly independent of the sole plate 2. Here, the heel counter members 3, 3' are fixedly attached to the peripheral portions 21, 22 of the sole plate 2 with glue, sewing and so on through connecting portions 30, 30' provided at the lower ends of the heel counter members 3, 3' respectively. In this exemplification, the connecting portions 30, 30' of the heel counter members 3, 3' are disposed on outside surfaces of the peripheral portions 21, 22 of the sole plate 2.

The heel counter members 3, 3' are separated from and preferably spaced away from the inverted V-shaped peripheral portion 23 of the sole plate 2 except the lower ends of the heel counter members 3, 3'. As shown in FIGS. 1 to 5, starting points 3*b*, 3'*b* of separation of the heel counter members 3, 3' from the inverted V-shaped peripheral members 3, 3' of the sole plate 2 are disposed below and behind the medial and lateral protruded portions below the medial and lateral malleoli K of the heel portion or below and behind the medial and lateral bulges of the calcaneus $C_A$ of the heel portion. Also, as seen in FIGS. 2 and 4, the heel counter members 3, 3' are not connected to one another at a rear end of the heel region of the shoe.

The sole plate 2 and each of the heel counter members 3, 3' are preferably formed of a hard elastic member, and more specifically, thermoplastic resin such as thermo plastic polyurethane (TPU), polyamide elastomer (PAE), and the like, or thermosetting resin such as epoxy resin, unsaturated polyester resin and the like. Also, the heel counter members 3, 3' may be formed of natural leather, artificial leather or synthetic leather. Alternatively, the heel counter members 3, 3' may be formed of non-woven fabric with impregnated resin.

Here, in this example, the sole plate 2 and the heel counter members 3, 3' are provided outside the upper U of the shoe, but either or both the sole plate 2 and the heel counter members 3, 3' may be provided inside the upper U. That is also applicable to the below-mentioned second to fourth embodiments, and sixth and seventh embodiments.

Figure 7:
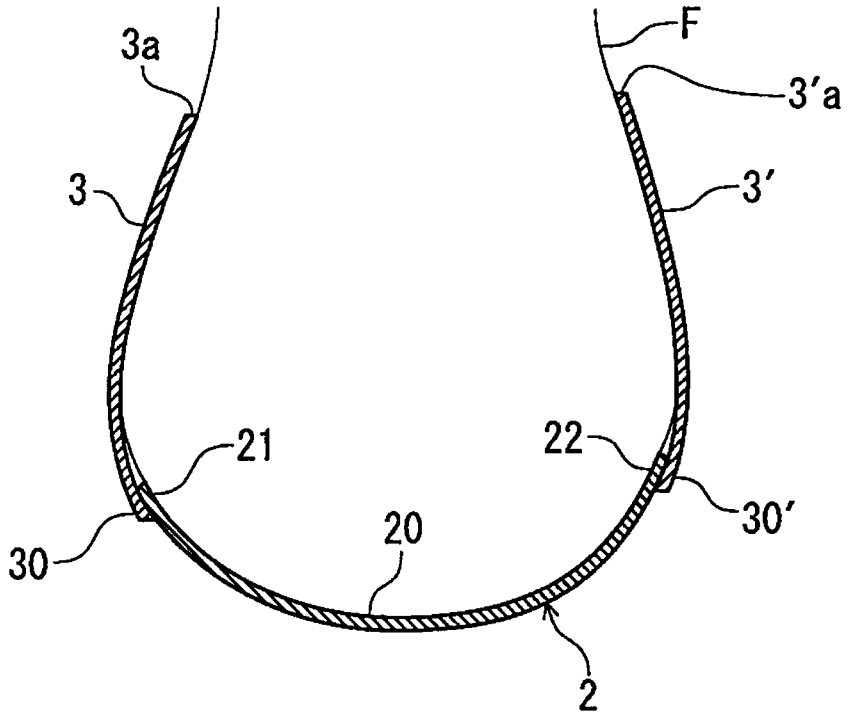
FIG. 7 is a cross sectional view of FIG. 6 taken along line A-A, illustrating the state in which a heel of a smaller width is held in the structure.
Figure 8:
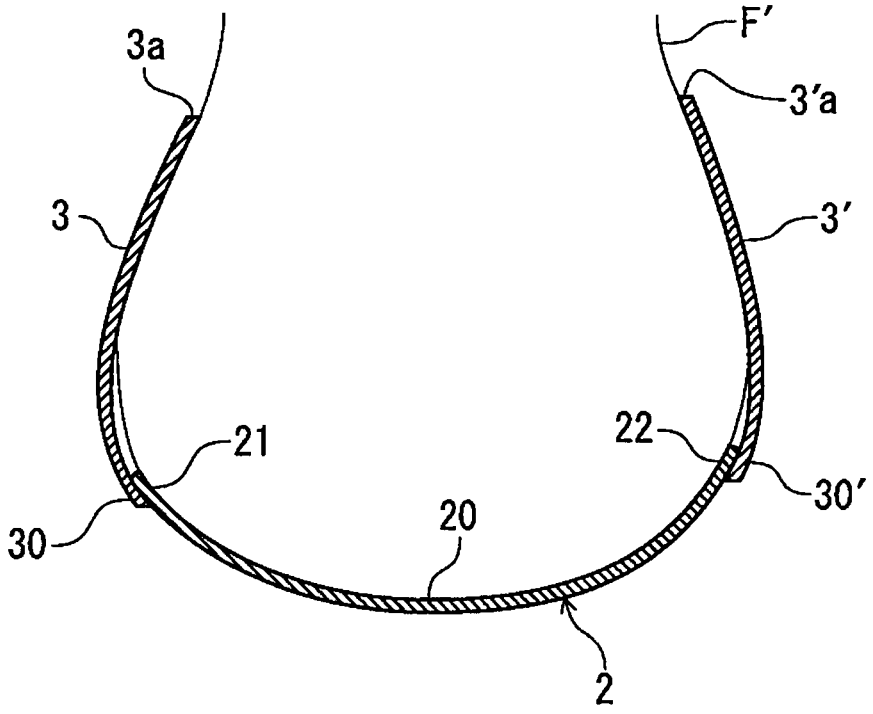
FIG. 8 is a cross sectional view of FIG. 6 taken along line A-A, illustrating the state in which a heel of a greater width is held in the structure.
Figure 9:
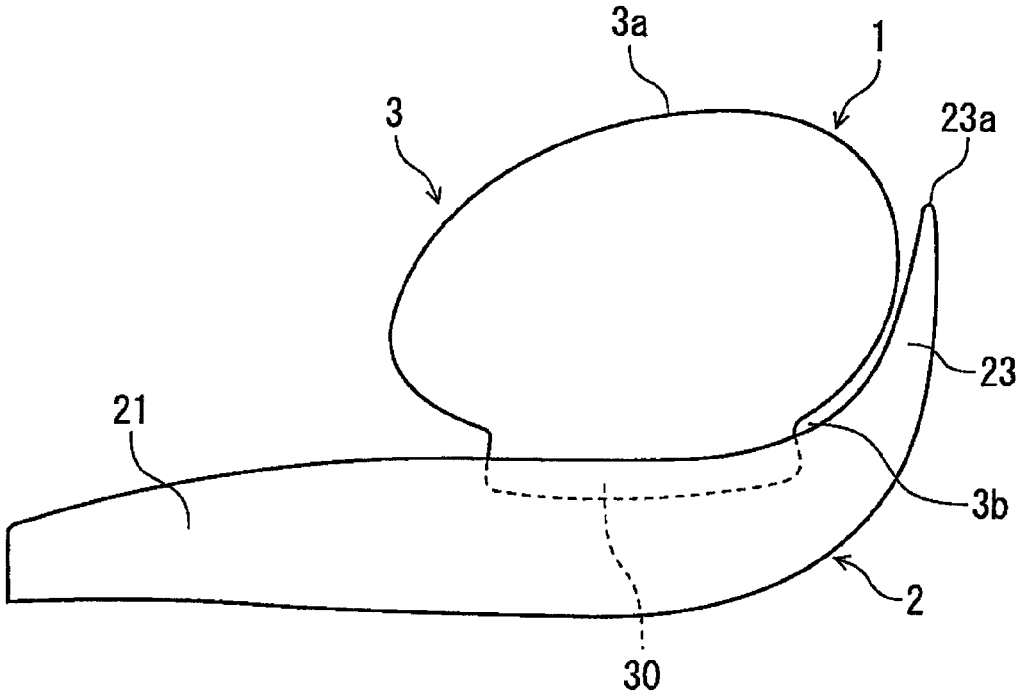
FIG. 9 is a lateral side view of a heel counter structure according to a second embodiment of the present invention.
Figure 10:
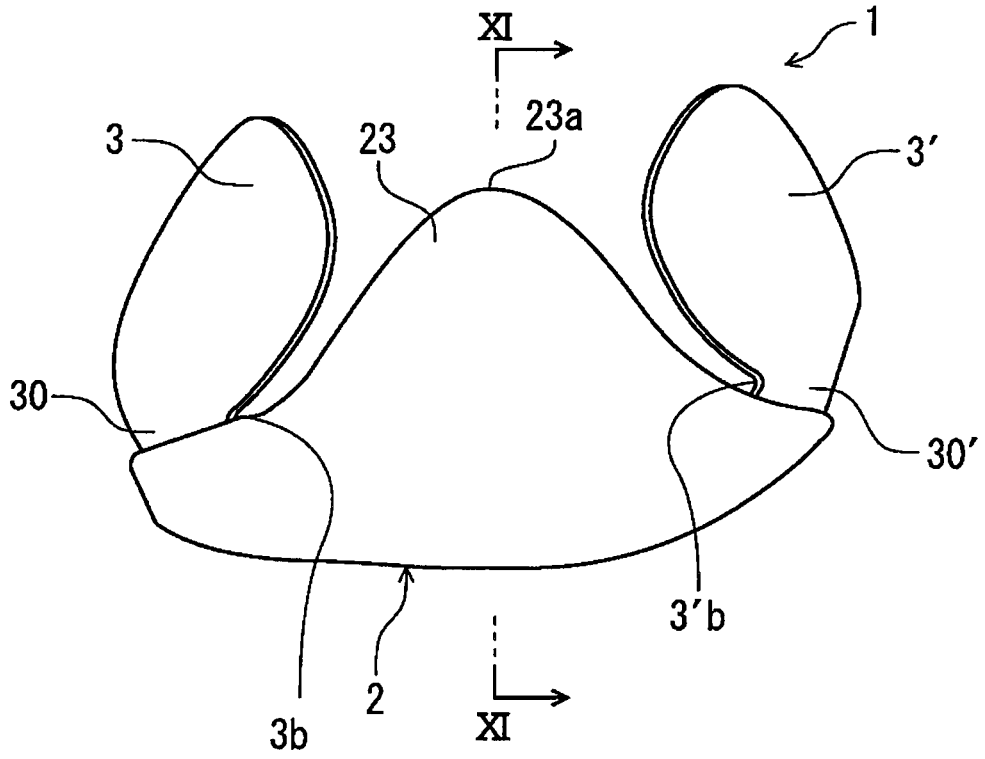
FIG. 10 is a rear side view of the heel counter structure of FIG. 9.
Figure 11:
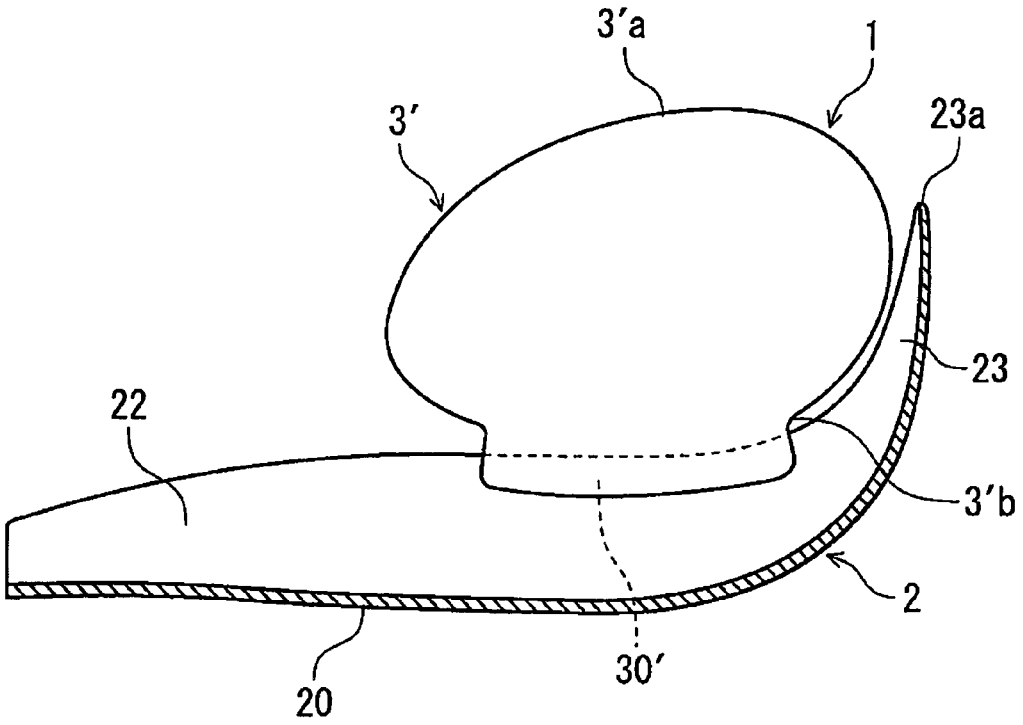
FIG. 11 is a longitudinal sectional view of FIG. 10 taken along line XI-XI.

According to the above-mentioned heel counter structure, when wearing the shoe, the heel lower portion of the foot of the wearer is supported by the peripheral portions 21, 22, 23 of the sole plate 2 (see FIGS. 7 and 8). At this juncture, the heel portion of the foot is sandwiched sideways by the heel counter members 3, 3' attached to the peripheral portions 21, 22 of the sole plate 2 (see FIGS. 7 and 8). Thereby, the heel portion of the foot can be held and supported and fittingness can be improved.

Also, in this case, the connecting portions 30, 30' at the lower ends of the heel counter members 3, 3' are coupled to the peripheral portions 21, 22 of the sole plate 2 such that the heel counter members 3, 3' can be tilted and deformed inwardly and outwardly independent of the sole plate 2. Accordingly, in the event that a heel width of the foot of the wearer is greater than a width of the sole plate 2 and thus the heel portion of the foot steps onto inside surfaces of the peripheral portions 21, 22 of the sole plate 2 to widen the peripheral portions 21, 22 sideways, the heel counter members 3, 3' tilts and is deformed outwardly (see a dash-and-dot line of FIG. 6). Thereby, the heel counter members 3, 3' hold to sandwich the heel portion of the foot sideways without leaving the heel portion of the foot (see FIG. 8). At this juncture, in order to increase inward and outward bendability of the heel counter members 3, 3', longitudinal lengths of the connecting portions 30, 30' should be shortened and thicknesses of the connecting portions 30, 30' should be thinned. Due to their bendability, the connecting portions 30, 30' can be considered as forming bendable hinge members.

In addition, if width of the sole plate 2 is designed beforehand to conform to the foot of a smaller heel width, in the case of the foot of a larger heel width relative to the width of the sole plate 2, each of the heel counter members 3, 3' tilts and is deformed outwardly and thus the heel portion of the foot is securely held sideways by the heel counter members 3, 3'.

In such a manner, the heel of the foot of the shoe wearer can be stably held at all times by the heel counter structure irrespective of width of the heel or size of calcaneus of the foot. On motion as well as in a state of rest, holdability and fittingness of the heel portion of the foot can be improved.

Also, in this case, by designing inner volume of the upper (or last volume) in the heel region of the shoe at a smaller value than volume of the heel portion of the foot, when wearing the shoe, the entire heel portion including corpus adiposum can be held in a small size, and holdability of the heel portion can thus be further improved.

Moreover, since the sole plate 2 has a round shape that conforms to the shape of the sole of the heel portion of the foot, when the foot is placed on the sole plate, the bottom surface of the heel portion of the foot maintains a round shape along the shape of the sole plate 2. Thereby, the heel portion of the foot can exhibit cushioning properties that the corpus adiposum used to have, and thickness of a sole of the shoe does not need to be thickened to improve cushioning properties, thus reducing the weight of the entire shoe.

Furthermore, since each of the heel counter members 3, 3' is separated from the inverted V-shaped peripheral portion 23 of the sole plate 2, inward and outward tilting movement and deformation of the heel counter members 3, 3' are smoothly carried out independent of the peripheral portion 23 of the sole plate 2.

Also, since the central part 23*a* of the inverted V-shaped peripheral portion 23 of the sole plate 2 is located at or near the most protruded part P of the heel rear portion of the foot, when wearing the shoe, the heel rear portion of the foot is supported longitudinally by the central part 23*a* of the inverted V-shaped peripheral portion 23 of the sole plate 2.

Moreover, in the event that the starting points 3*b*, 3*b'* of separation of the heel counter members 3, 3' from the inverted V-shaped peripheral portion 23 of the sole plate 2 are located at positions below and behind the bulges on the medial and lateral sides of the foot below the medial and lateral malleoli K of the heel portion or below and behind the medial and lateral bulges of the calcaneus $C_A$ of the heel portion, when the heel counter members 3, 3' are tilted and deformed outwardly around the starting points 3*b*, 3*b'*, the heel counter members 3, 3' can securely contact the bulges on the medial and lateral sides of the foot or the medial and lateral bulges of the calcaneus $C_A$ of the heel portion sideways. Thereby, the heel portion can be securely held sideways.

Furthermore, in the event that the heel counter members 3, 3' are spaced away from the inverted V-shaped peripheral portion 23 of the sole plate 2, inward and outward tilting movement and deformation of the heel counter members 3, 3' are smoothly carried out independent of the peripheral portion 23 of the sole plate 2 without interfering with the peripheral portion 23.

Also, when the upper end edge portions 3*a*, 3'*a* of the heel counter members 3, 3' extend to the lower portions of the malleoli K on the medial and lateral sides of the foot and the heel counter members 3, 3' cover the bulges on the medial and lateral sides of the heel portion of the foot or the medial and lateral bulges of the calcaneus $C_A$ of the heel portion, the heel counter members 3, 3' can hold large areas of the heel portion of the foot without impeding movements of the foot.

Additionally, as shown in the first embodiment, when the heel counter members 3, 3' are disposed outside the sole plate 2, if in a manufacturing process of the shoe the heel counter members are assembled as a part of the upper of the shoe through sewing or gluing and the sole plate is disposed as an insole board which the upper enwraps, the insole board does not need to be prepared discretely thus simplifying the manufacturing process and making the shoe lightweight.

Second Embodiment

In the above-mentioned first embodiment, the connecting portions 30, 30' of the heel counter members 3, 3' were disposed outside the peripheral portions 21, 22 of the sole plate 2, but application of the present invention is not restricted to such an example.

FIGS. 9 to 13 show a heel counter structure according to a second embodiment of the present invention. In these drawings, like reference numbers indicate identical or functionally similar elements. This second embodiment differs from the first embodiment in that the connecting portion 30, 30' of the heel counter members 3, 3' were disposed inside the peripheral portions 21, 22 of the sole plate 2.

Figure 12:
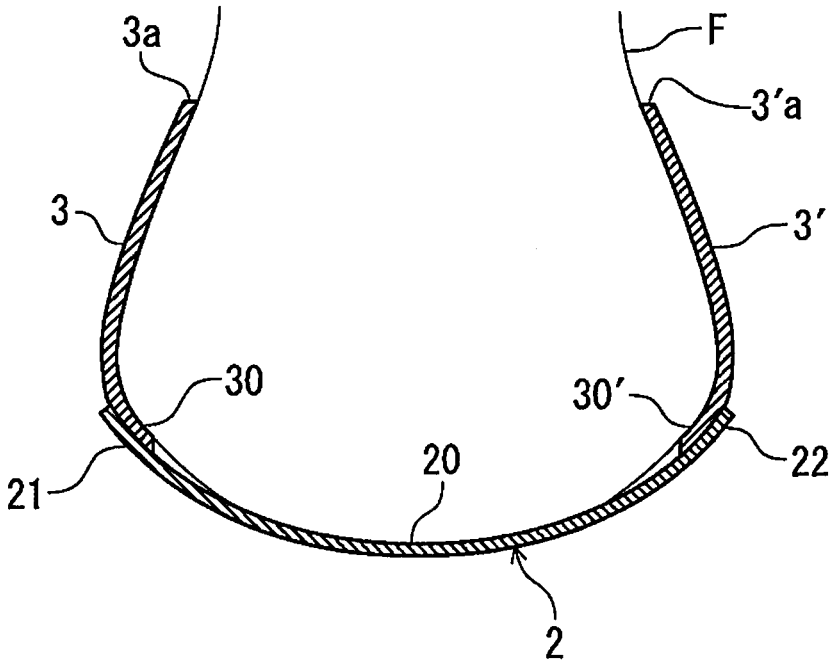
FIG. 12 is a cross sectional view of FIG. 9, illustrating the state in which a heel of a smaller width is held in the structure.
Figure 13:
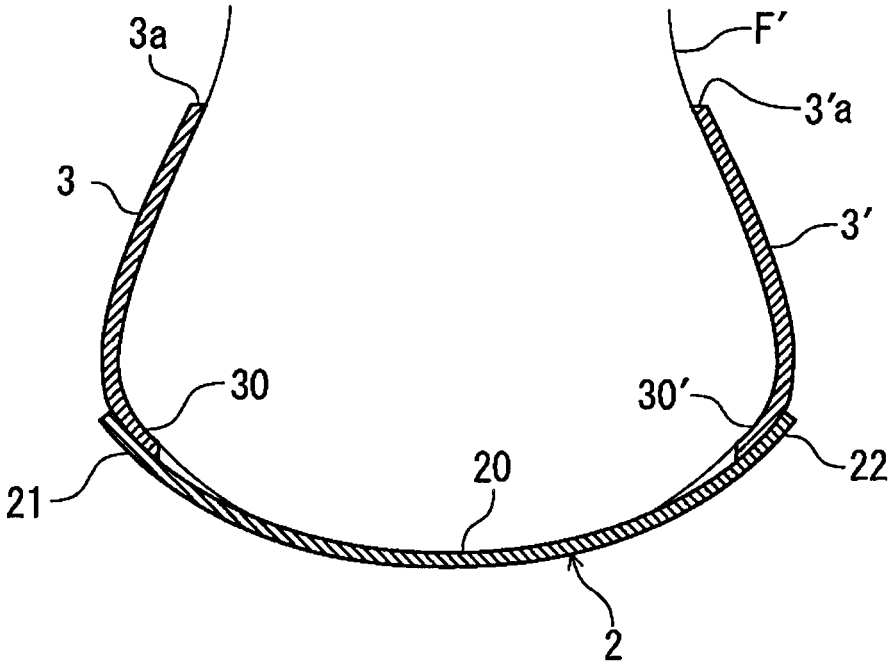
FIG. 13 is a cross sectional view of FIG. 9, illustrating the state in which a heel of a greater width is held in the structure.
Figure 14:
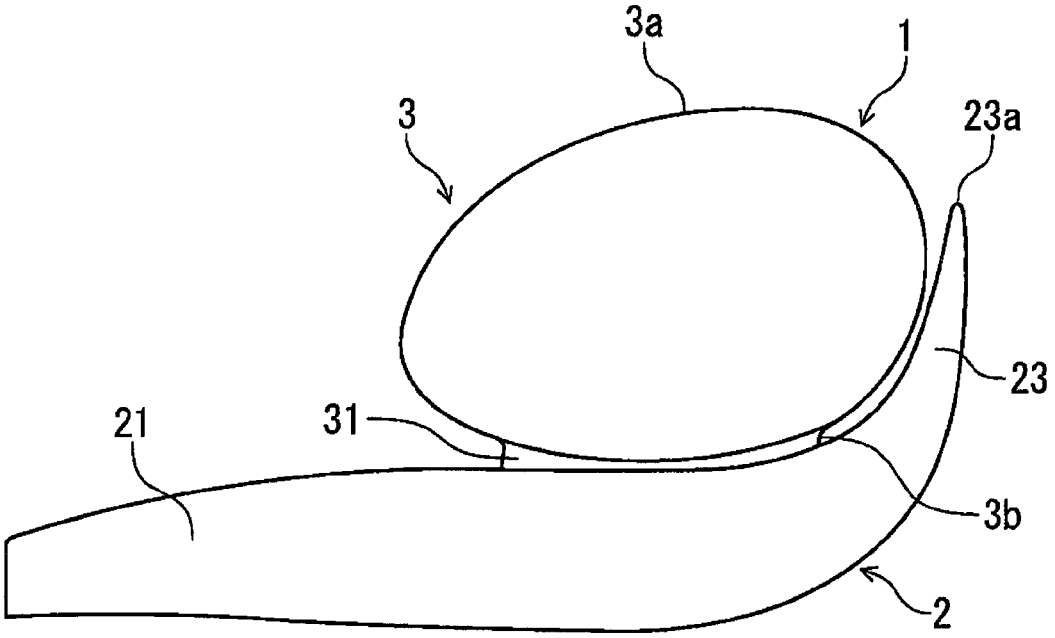
FIG. 14 is a lateral side view of a heel counter structure according to a third embodiment of the present invention.
Figure 15:
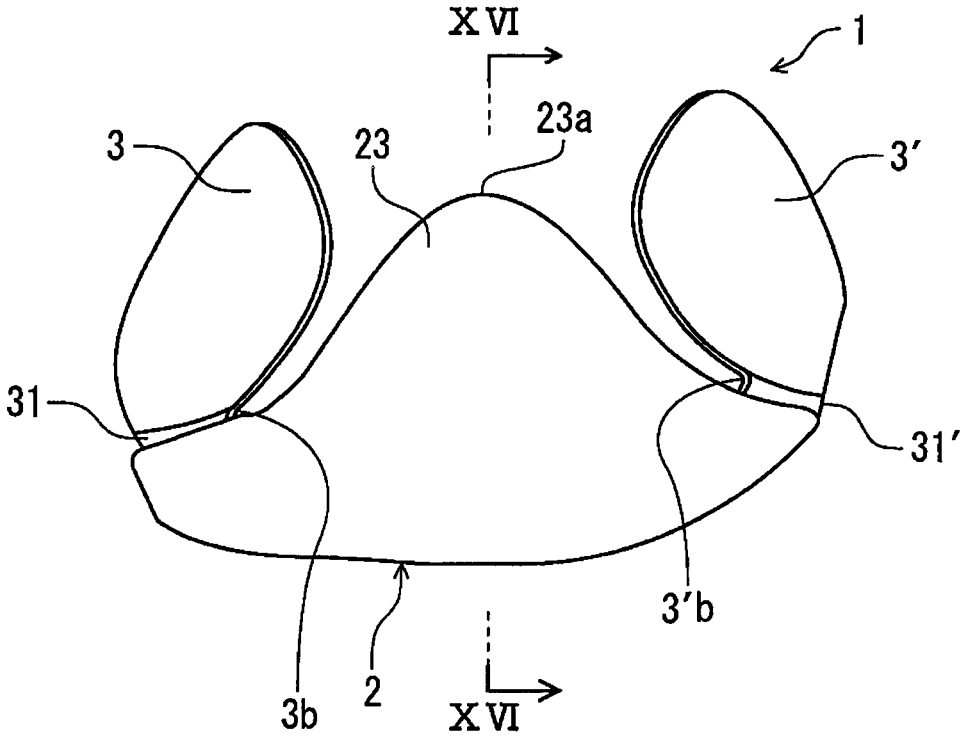
FIG. 15 is a rear side view of the heel counter structure of FIG. 14.
Figure 16:
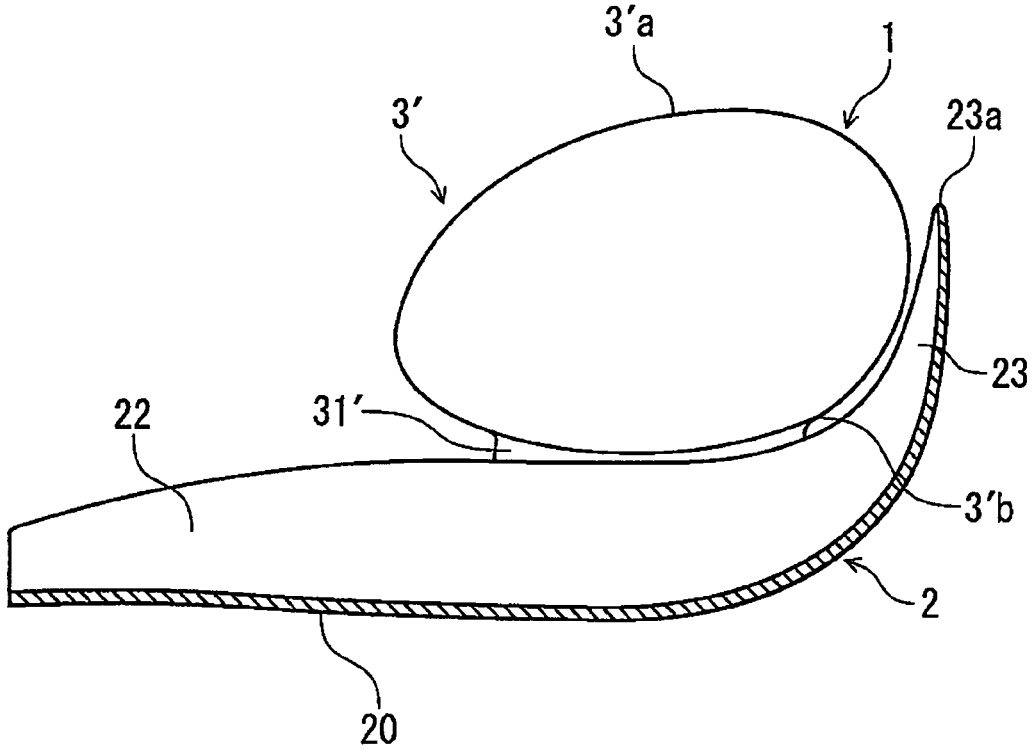
FIG. 16 is a longitudinal sectional view of FIG. 15 taken along line XVI-XVI.

In the second embodiment as well, when wearing the shoe, the heel lower portion of the foot of the wearer is held by the peripheral portions 21, 22, 23 of the sole plate 2 and the heel portion of the foot is sandwiched by the heel counter members 3, 3' sideways attached to the peripheral portions 21, 22 of the sole plate 2 (see FIGS. 12 and 13). Thereby, the heel portion of the foot can be held and supported and fittingness can be improved.

Also, since the connecting portions 30, 30' at the lower ends of the heel counter members 3, 3' are coupled to the peripheral portions 21, 22 of the sole plate 2 such that the heel counter members 3, 3' can be tilted and deformed inwardly and outwardly independent of the sole plate 2, if the heel width of the foot of the wearer is greater than the width of the sole plate 2, the heel counter members 3, 3' is tilted and deformed outwardly and holds to sandwich the heel portion of the foot sideways or from the medial and lateral sides (see FIG. 13).

In such a manner, the heel of the foot of the shoe wearer can be stably held at all times by the heel counter structure irrespective of width of the heel or size of calcaneus of the foot. On motion as well as in a state of rest, holdability and fittingness of the heel portion of the foot can be improved.

Additionally, as shown in the second embodiment, when the sole plate 2 is disposed outside the heel counter members 3, 3', the sole plate 2 can be exposed outside the upper of the shoe, thus improving decorativeness of the exterior of the shoe by for example, making various designs on the sole plate when resin-molding the sole plate.

Third Embodiment

In the above-mentioned first and second embodiments, the lower ends of the heel counter members 3, 3' were disposed outside or inside the peripheral portions 21, 22 of the sole plate 2, but application of the present invention is not restricted to these examples.

FIGS. 14 to 18 show a heel counter structure according to a third embodiment of the present invention. In these drawings, like reference numbers indicate identical or functionally similar elements. The third embodiment is different from the first and second embodiments in that lower end surfaces of the heel counter members 3, 3' were positioned against and connected to upper end surfaces of the peripheral portions 21, 22 of the sole plate 2. That is, in this third embodiment, the heel counter members 3, 3' are fixedly attached (e.g. glued or sewed) directly to the upper end surfaces of the peripheral portions 21, 22 of the sole plate 2 through connecting portions 31, 31' provided at bottom portions of the heel counter members 3, 3'.

In this case, the connecting portions 31, 31' are thinner than the heel counter members 3, 3' thus enhancing bendability of the heel counter members 3, 3'.

Figure 17:
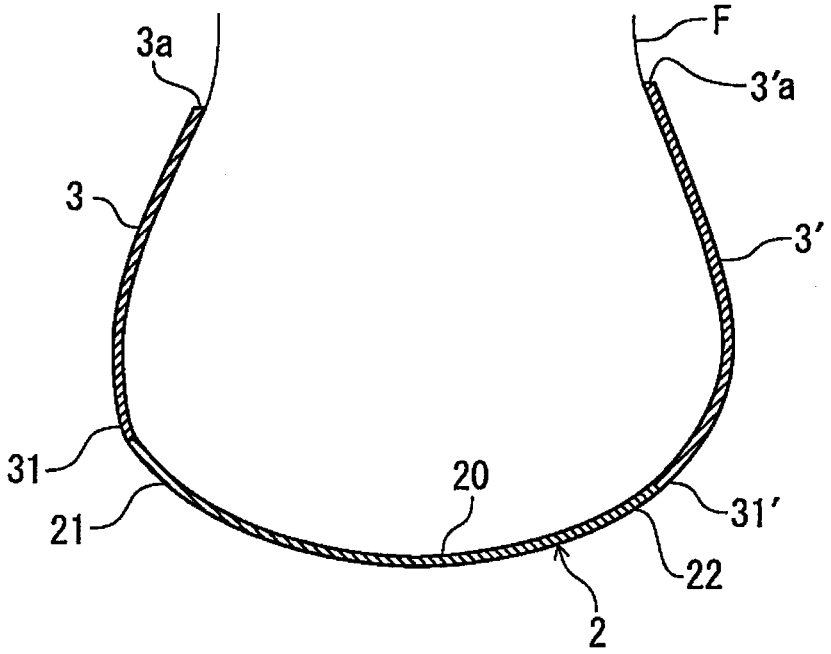
FIG. 17 is a cross sectional view of FIG. 14, illustrating the state in which a heel of a smaller width is held in the structure.
Figure 18:
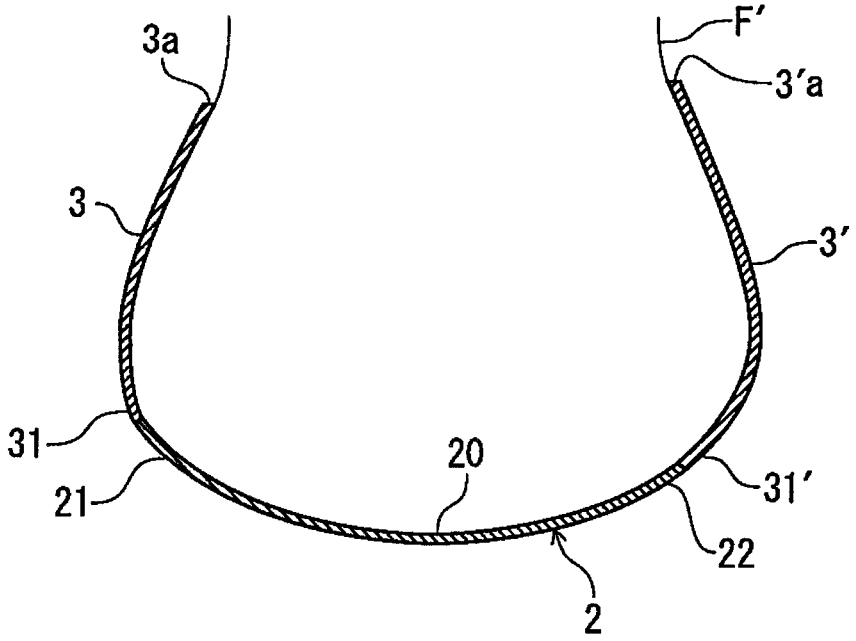
FIG. 18 is a cross sectional view of FIG. 14, illustrating the state in which a heel of a greater width is held in the structure.
Figure 19:
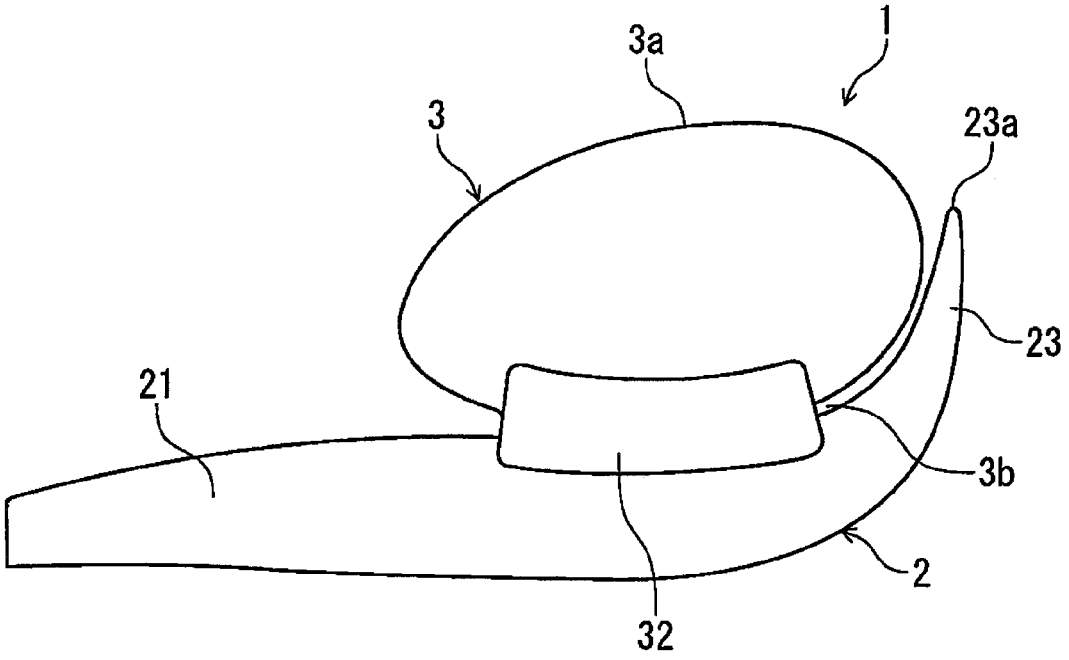
FIG. 19 is a lateral side view of a heel counter structure according to a fourth embodiment of the present invention.
Figure 20:
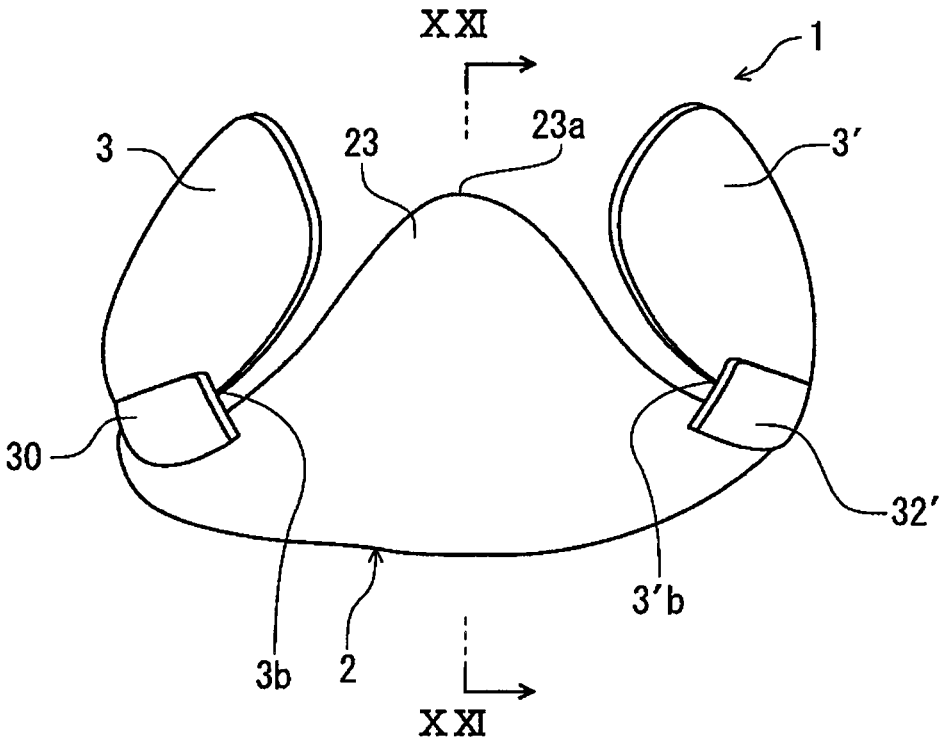
FIG. 20 is a rear side view of the heel counter structure of FIG. 19.
Figure 21:
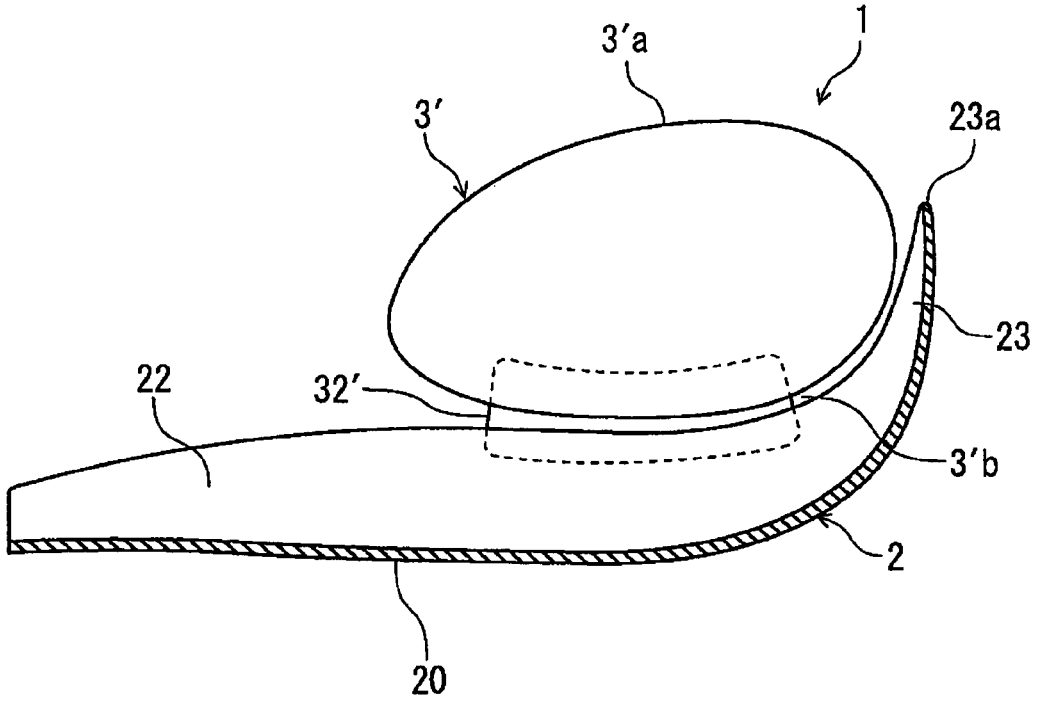
FIG. 21 is a longitudinal sectional view of FIG. 20 taken along line XXI-XXI.

In the third embodiment as well, when wearing the shoe, the heel lower portion of the foot of the wearer is held by the peripheral portions 21, 22, 23 of the sole plate 2 and the heel portion of the foot is sandwiched sideways by the heel counter members 3, 3' attached to the peripheral portions 21, 22 of the sole plate 2 (see FIGS. 17 and 18). Thereby, the heel portion of the foot can be held and supported and fittingness can be improved.

Also, since the connecting portions 31, 31' at the lower ends of the heel counter members 3, 3' are coupled to the peripheral portions 21, 22 of the sole plate 2 such that the heel counter members 3, 3' can be tilted and deformed inwardly and outwardly independent of the sole plate 2, if the heel width of the foot of the wearer is greater than the width of the sole plate 2, the heel counter members 3, 3' is tilted and deformed outwardly and the heel portion of the foot is sandwiched and held sideways by the heel counter members 3, 3' (see FIG. 18).

In such a manner, the heel of the foot of the shoe wearer can be stably held at all times by the heel counter structure irrespective of width of the heel or size of calcaneus of the foot. On motion as well as in a state of rest, holdability and fittingness of the heel of the foot can be improved.

Fourth Embodiment

In the above-mentioned first to third embodiments, the connecting portions 30, 30', 31, 31' provided at the lower ends of the heel counter members 3, 3' were formed integrally with lower regions of the heel counter members 3, 3', but application of the present invention is not restricted to these examples.

FIGS. 19 to 23 illustrate a heel counter structure according to a fourth embodiment of the present invention. In these drawings, like reference numbers indicate identical or functionally similar elements. The fourth embodiment differs from the first to third embodiments in that connecting portions 32, 32' are provided discretely from the heel counter members 3, 3'. The connecting portions 32, 32' are longitudinally extending band-shaped members and are fixedly attached (e.g. glued or sewed) to the outside surfaces of the heel counter members 3, 3' and the peripheral portions 21, 22 at the lower ends of the heel counter members 3, 3' and the upper ends of the peripheral portions 21, 22 of the sole plate 2.

In this case, the connecting portions 32, 32' may be formed of the same material as or different material from the heel counter members 3, 3'. Preferably, the connecting portions 32, 32' are formed of softer member (e.g. soft resin or rubber) than the heel counter members 3, 3'.

Figure 22:
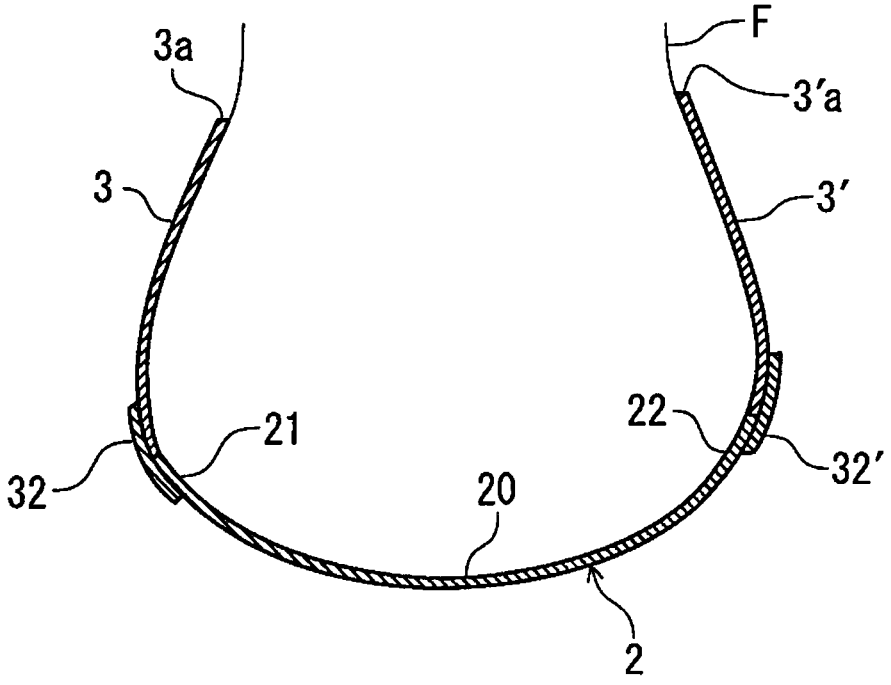
FIG. 22 is a cross sectional view of FIG. 19, illustrating the state in which a heel of a smaller width is held in the structure.
Figure 23:
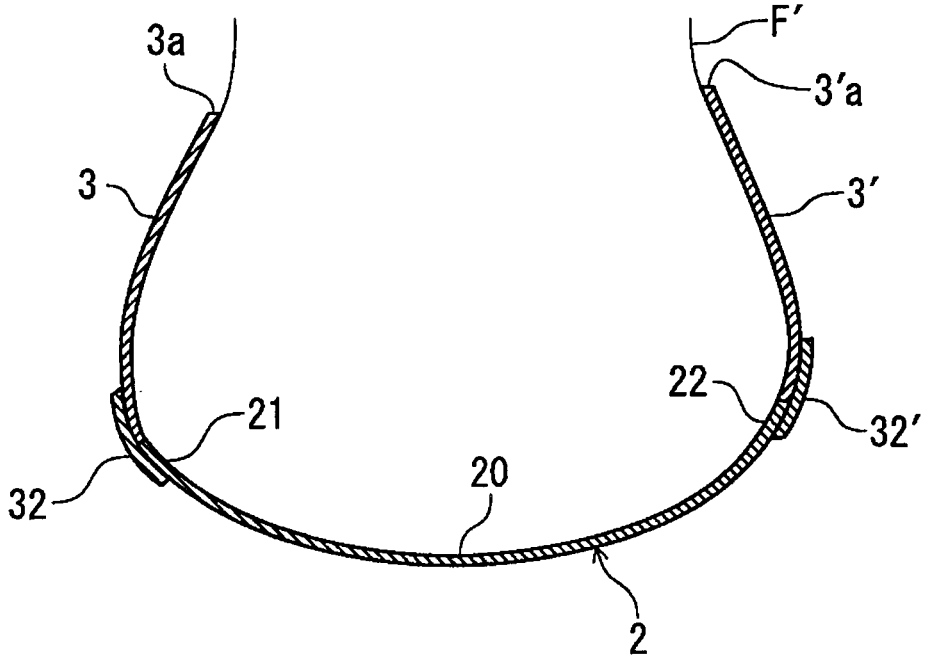
FIG. 23 is a cross sectional view of FIG. 19, illustrating the state in which a heel of a greater width is held in the structure.

In the fourth embodiment as well, when wearing the shoe, the heel lower portion of the foot of the wearer is held by the peripheral portions 21, 22, 23 of the sole plate 2 and the heel portion of the foot is sandwiched sideways by the heel counter members 3, 3' connected to the peripheral portions 21, 22 of the sole plate 2 through the connecting portions 32, 32' (see FIGS. 22 and 23). Thereby, the heel portion of the foot can be held and supported and fittingness can be improved.

Also, since the lower ends of the heel counter members 3, 3' are coupled to the peripheral portions 21, 22 of the sole plate 2 through the connecting portions 32, 32' such that the heel counter members 3, 3' can be tilted and deformed inwardly and outwardly independent of the sole plate 2, if the heel width of the foot of the wearer is greater than the width of the sole plate 2, the heel counter members 3, 3' are tilted and deformed outwardly and the heel portion of the foot is thus sandwiched and held sideways by the heel counter members 3, 3' (see FIG. 23).

In such a manner, the heel of the foot of the shoe wearer can be stably held at all times by the heel counter structure irrespective of width of the heel or size of calcaneus of the foot. On motion as well as in a state of rest, holdability and fittingness of the heel of the foot can be improved.

Fifth Embodiment

In the above-mentioned fourth embodiment, the connecting portions 32, 32' provided at the lower ends of and discretely from the heel counter members 3, 3' were formed of longitudinally extending band-shaped members, but application of the present invention is not restricted to such an example.

Figure 24:
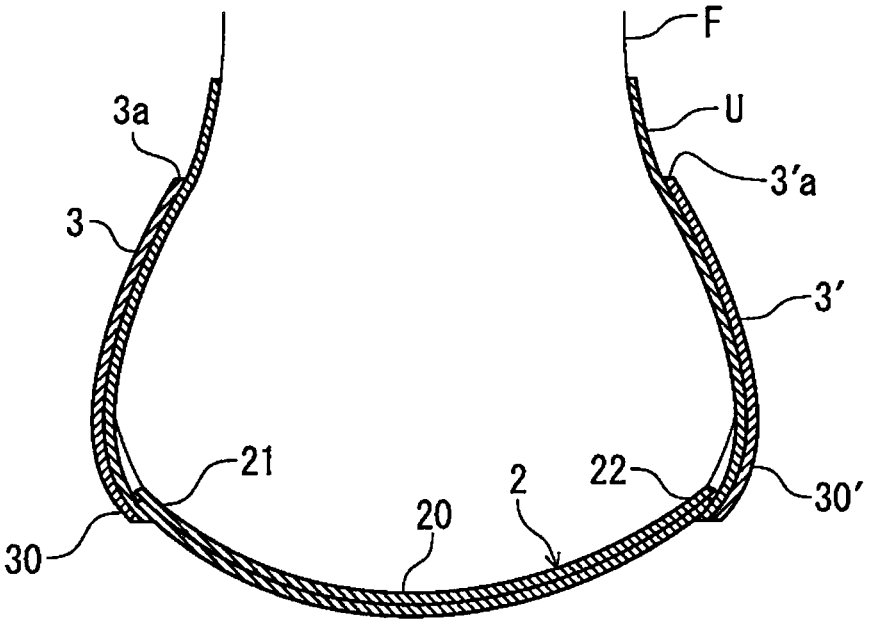
FIG. 24 is a cross sectional view of a heel counter structure according to a fifth embodiment of the present invention.
Figure 25:
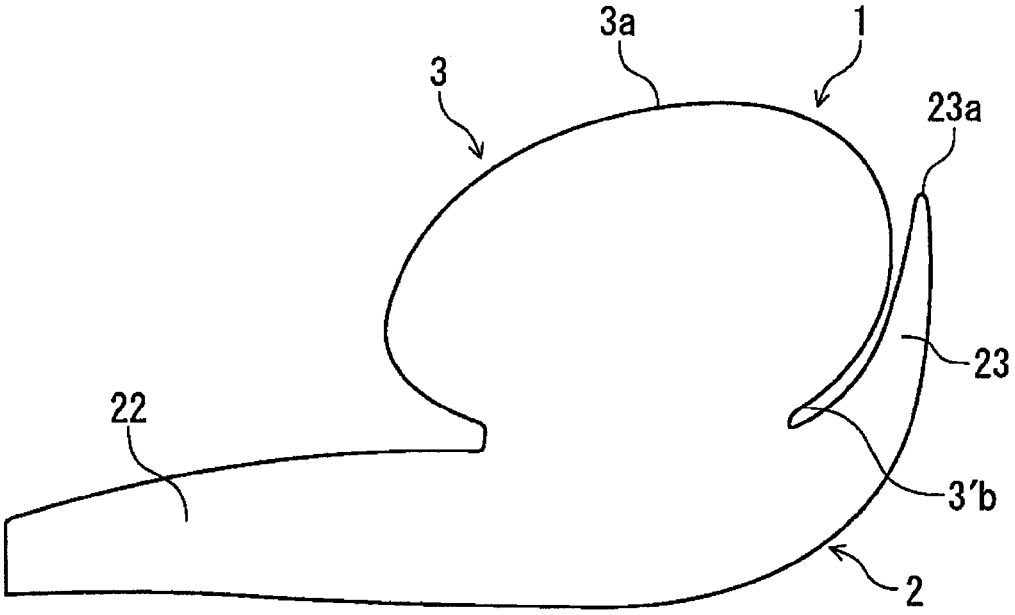
FIG. 25 is a lateral side view of a heel counter structure according to a sixth embodiment of the present invention.
Figure 26:
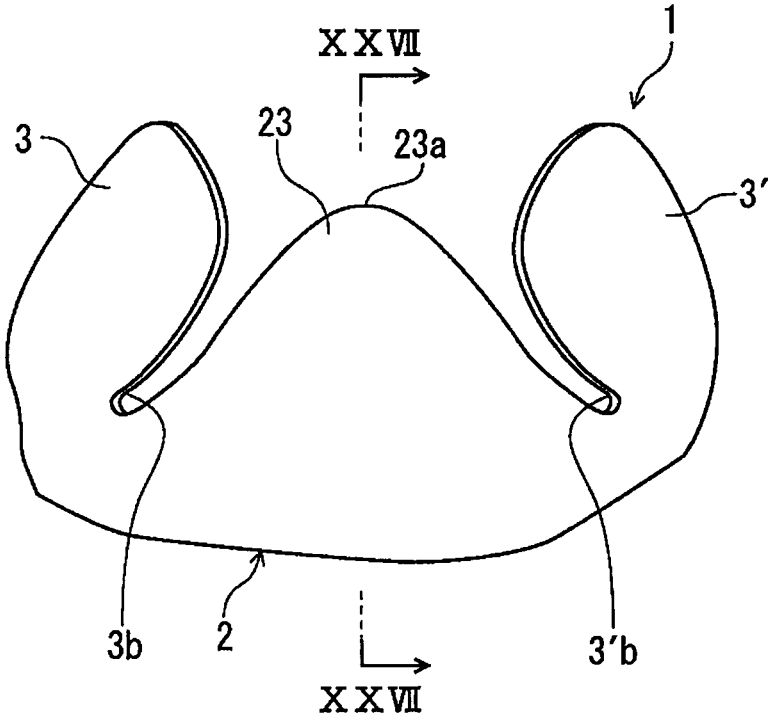
FIG. 26 is a rear side view of the heel counter structure of FIG. 25.
Figure 27:
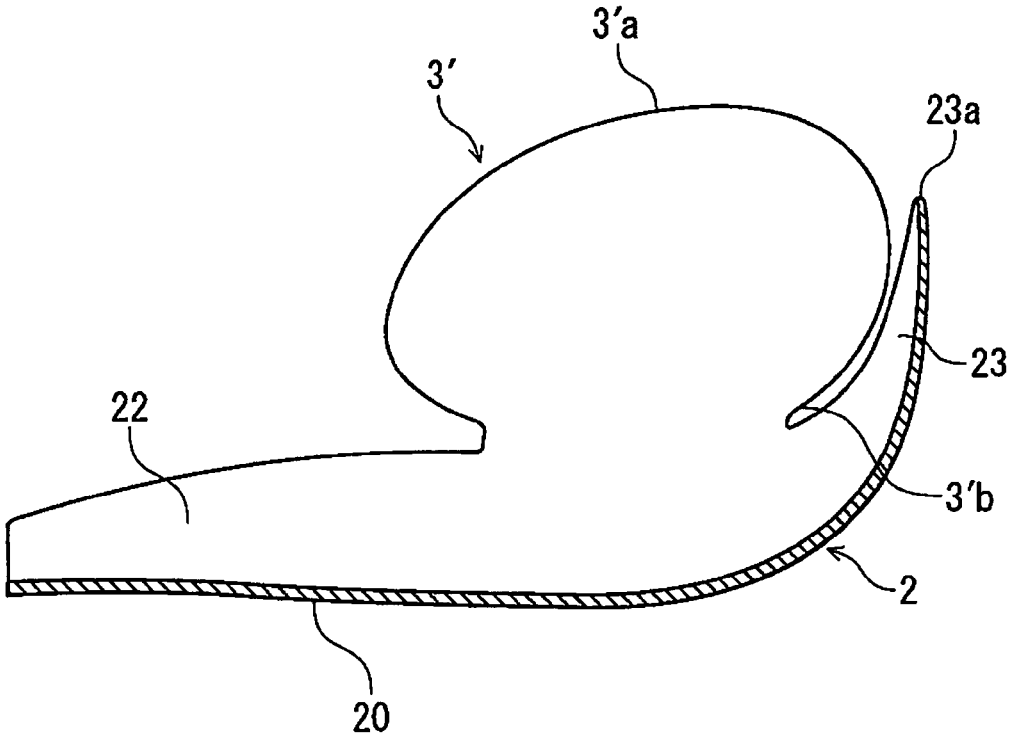
FIG. 27 is a longitudinal sectional view of FIG. 26 taken along line XXVII-XXVII.

FIG. 24 illustrates a heel counter structure according to a fifth embodiment of the present invention. In the drawing, like reference numbers indicate identical or functionally similar elements. In this fifth embodiment, as a connecting member provided discretely from the heel counter members 3, 3', an upper U of the shoe is utilized. In this exemplification, inside the upper U medial and lateral side portions of the sole plate 2 is disposed and outside the upper U the heel counter members 3, 3' are disposed. The sole plate 2 and the heel counter members 3, 3' are fixedly attached to the upper U through gluing, sewing or the like. The lower ends of the heel counter members 3, 3' overlap with the upper end edge portions 21, 22 of the sole plate 2 in a thickness direction.

In this case, since the upper U is formed of relatively soft material such as leather, fibers or the like, by connecting the heel counter members 3, 3' to the sole plate 2 via the upper U, bendability of the heel counter members 3, 3' is enhanced.

In the fifth embodiment as well, when wearing the shoe, the heel lower portion of the foot of the wearer is held by the peripheral portions 21, 22, 23 of the sole plate 2 and the heel portion of the foot is sandwiched sideways by the heel counter members 3, 3' connected to the peripheral portions 21, 22 of the sole plate 2 through the upper U (see FIG. 24). Thereby, the heel portion of the foot can be held and fittingness can be enhanced.

Also, since the lower ends of the heel counter members 3, 3' are coupled to the peripheral portions 21, 22 of the sole plate 2 through the upper U such that the heel counter members 3, 3' can be tilted and deformed inwardly and outwardly independent of the sole plate 2, if the heel width of the foot of the wearer is greater than the width of the sole plate 2, the heel counter members 3, 3' are tilted and deformed outwardly and the heel portion of the foot is thus sandwiched and held sideways by the heel counter members 3, 3' (see FIG. 24).

In such a way, the heel of the foot of the shoe wearer can be stably held at all times by the heel counter structure irrespective of width of the heel or size of calcaneus of the foot. On motion as well as in a state of rest, holdability and fittingness of the heel of the foot can be enhanced.

In addition, both the heel counter members 3, 3' and the sole plate 2 may be disposed outside the upper U. At this juncture, the lower ends of the heel countermembers 3, 3' are preferably separated from the upper ends of the peripheral portions 21, 22 of the sole plate 2 in order to maintain bendability of the heel counter members 3, 3'.

Sixth Embodiment

In the above-mentioned first to fifth embodiments, the heel counter members 3, 3' were provided discretely from the sole plate 2, but application of the present invention is not restricted to such an example.

FIGS. 25 to 28 illustrate a heel counter structure according to a sixth embodiment of the present invention. In these drawings, like reference numbers indicate identical or functionally similar elements. The sixth embodiment differs from the first to fifth embodiments in that the heel counter members 3, 3' are formed integrally with the sole plate 2.

Figure 28:
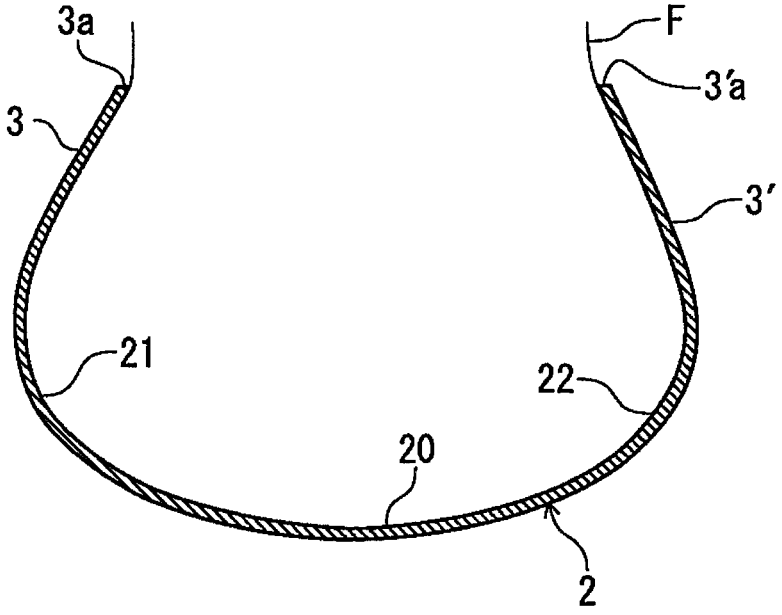
FIG. 28 is a cross sectional view of FIG. 25, illustrating the state in which a heel is held in the structure.
Figure 29:
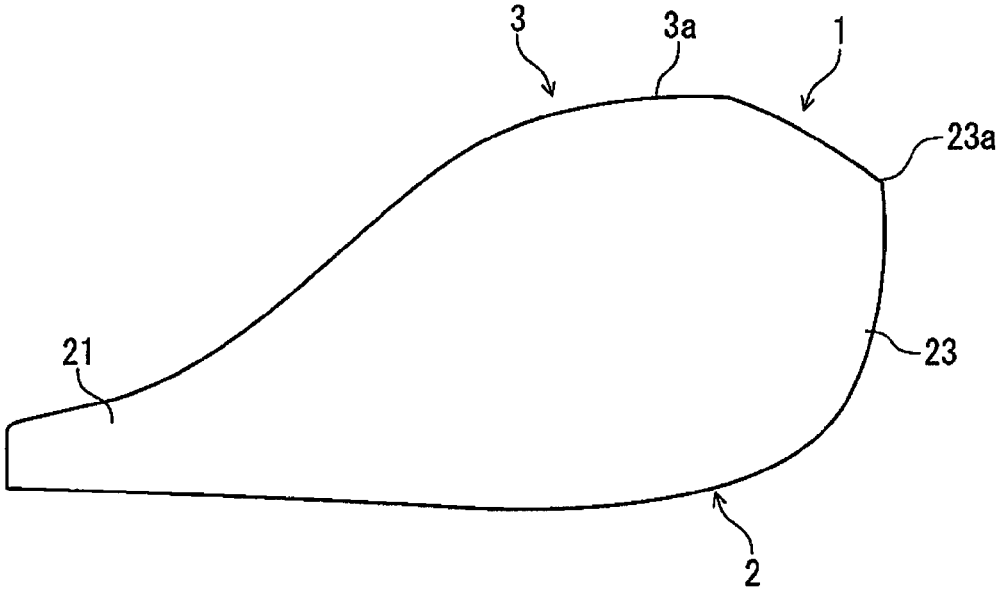
FIG. 29 is a lateral side view of a heel counter structure according to a seventh embodiment of the present invention.
Figure 30:
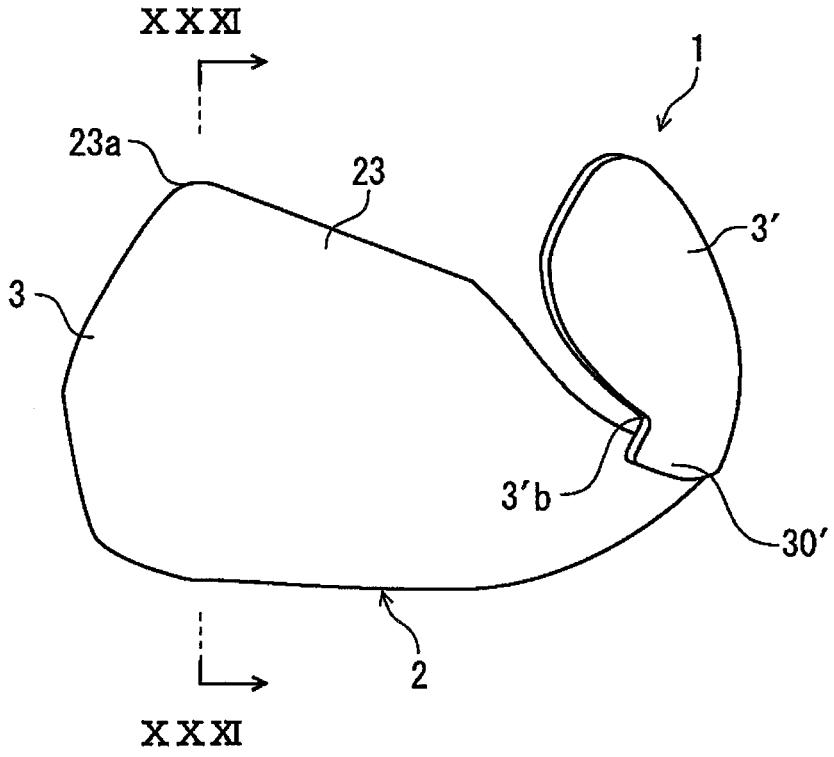
FIG. 30 is a rear side view of the heel counter structure of FIG. 29.
Figure 31:
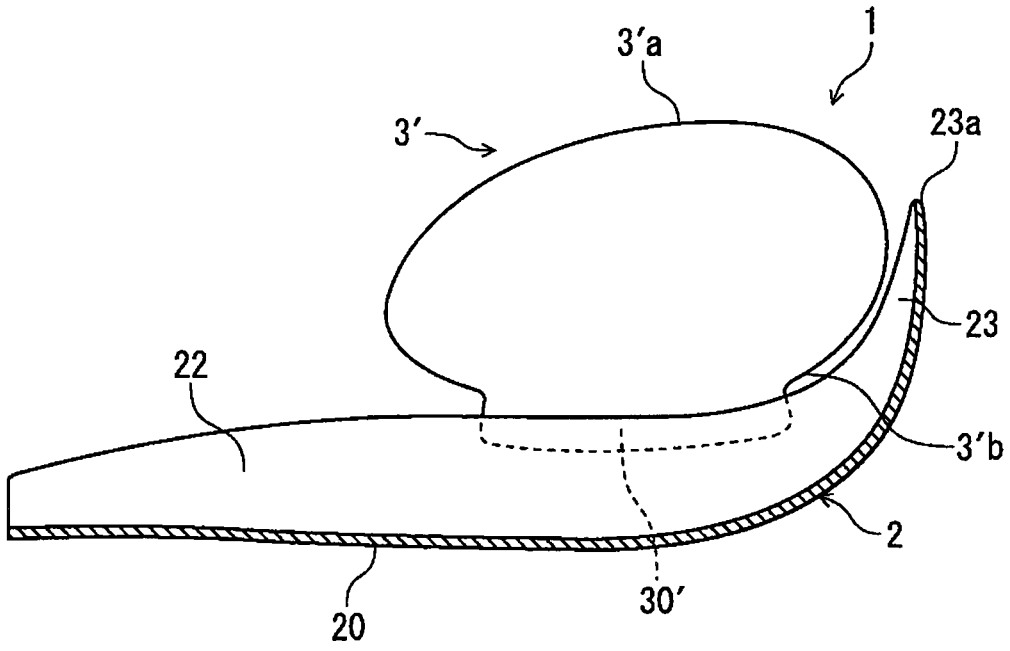
FIG. 31 is a longitudinal sectional view of FIG. 30 taken along line XXXI-XXXI.

In the sixth embodiment as well, when wearing the shoe, the heel lower portion of the foot of the wearer is held by the peripheral portions 21, 22, 23 of the sole plate 2 and the heel portion of the foot is sandwiched sideways by the heel counter members 3, 3' connected to the peripheral portions 21, 22 of the sole plate 2 (see FIG. 28). Thereby, the heel portion of the foot can be held and supported and fittingness is improved.

Also, since the lower ends of the heel counter members 3, 3' are connected to the peripheral portions 21, 22 of the sole plate 2 such that the heel counter members 3, 3' can be tilted and deformed inwardly and outwardly independent of the sole plate 2, if the heel width of the foot of the wearer is greater than the width of the sole plate 2, the heel counter members 3, 3' are tilted and deformed outwardly and the heel portion of the foot is thus sandwiched and held sideways by the heel counter members 3, 3' (see FIG. 28).

In such a way, the heel of the foot of the shoe wearer can be stably held all the time by the heel counter structure regardless of width of the heel or size of calcaneus of the foot. On motion as well as in a state of rest, holdability and fittingness of the heel of the foot can be improved. Moreover, in this case, there is no need to fixedly attach the heel counter members 3, 3' to the sole plate 2, thereby simplifying a shoe assembly process.

Seventh Embodiment

In the first to fifth embodiments, both of the heel counter members 3, 3' were made discretely from the sole plate 2, and in the sixth embodiment, both of the heel counter members 3, 3' were formed integrally with the sole plate 2, but application of the present invention is not restricted to these examples.

FIGS. 29 to 32 depict a heel counter structure according to a seventh embodiment of the present invention. In these drawings, like reference numbers indicate identical or functionally similar elements. The seventh embodiment is different from the first to sixth embodiments in that the heel counter member 3 provided on the lateral side of the shoe is formed integrally with the sole plate 2 and the heel counter member 3' provided on the medial side of the shoe is provided discretely from the sole plate 2 and connected to the peripheral portion 22 of the sole plate 2.

Figure 32:
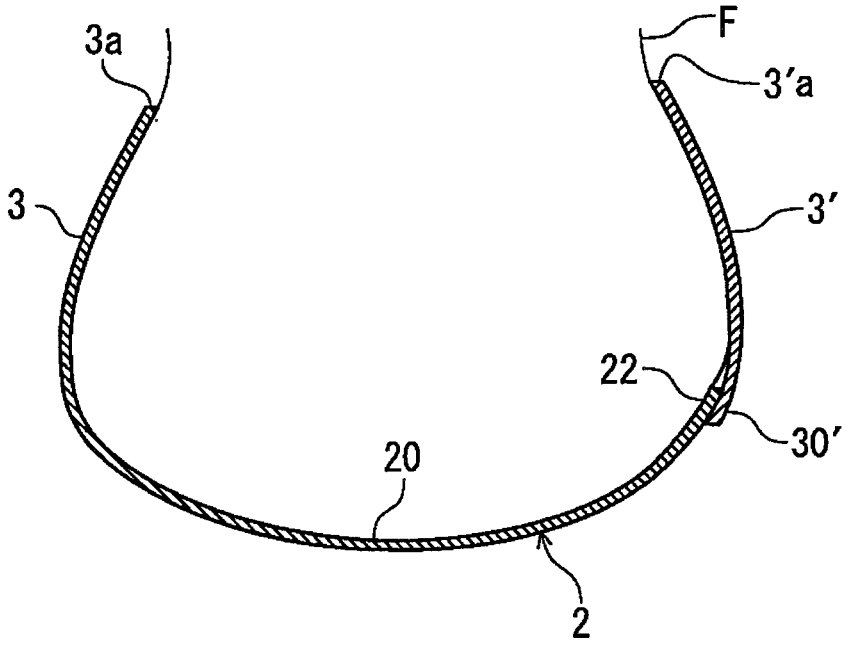
FIG. 32 is a cross sectional view of FIG. 29, illustrating the state in which a heel is held in the structure.
Figure 33:
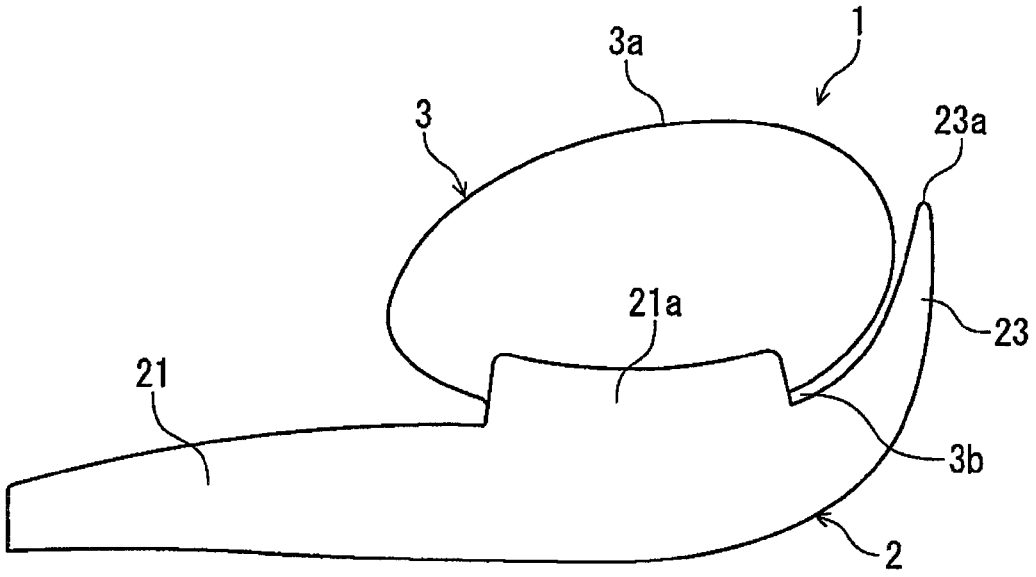
FIG. 33 is a lateral side view of a heel counter structure according to an eighth embodiment of the present invention.
Figure 34:
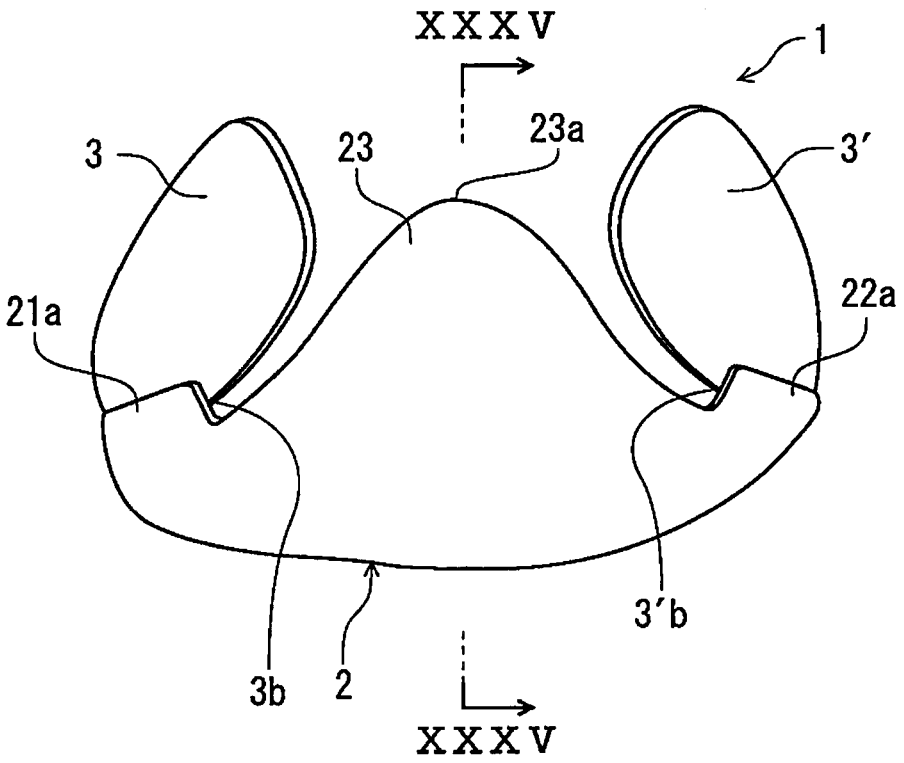
FIG. 34 is a rear side view of the heel counter structure of FIG. 33.
Figure 35:
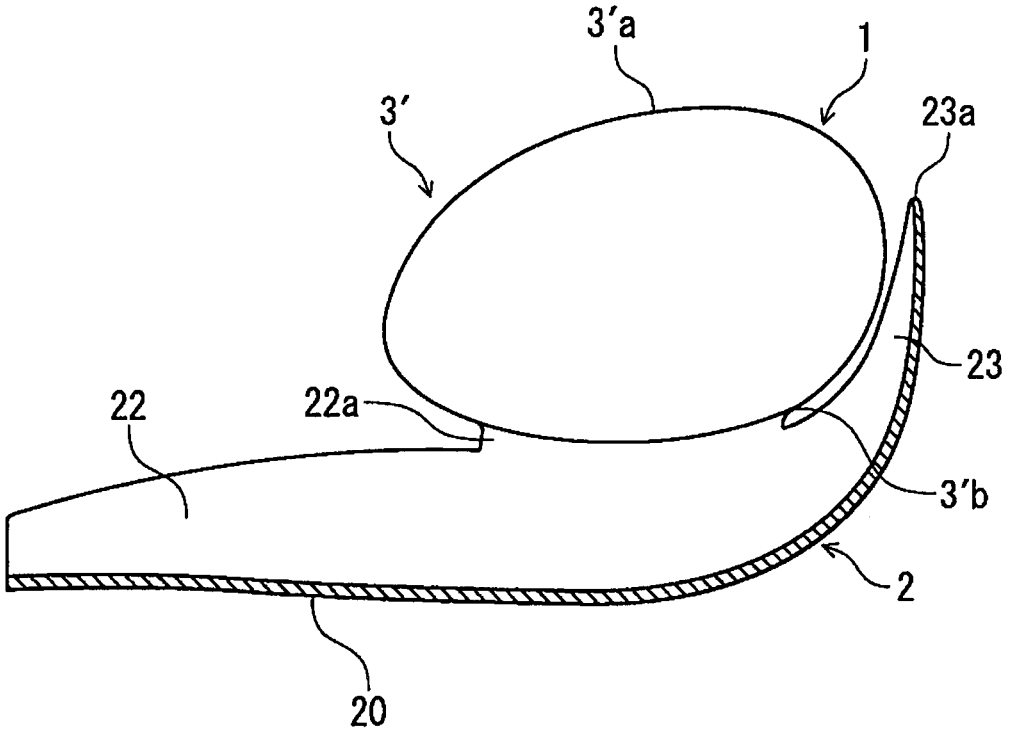
FIG. 35 is a longitudinal sectional view of FIG. 34 taken along line XXXV-XXXV.

In the seventh embodiment too, when wearing the shoe, the heel lower portion of the foot of the wearer is held by the peripheral portions 21, 22, 23 of the sole plate 2 and the heel portion is sandwiched sideways by the heel counter members 3, 3' (see FIG. 32). Thereby, the heel portion of the foot can be held and supported and fittingness can be improved.

Also, since the lower end of the heel counter member 3' is connected to the peripheral portions 22 of the sole plate 2 such that the heel counter member 3' can be tilted and deformed inwardly and outwardly independent of the sole plate 2, if the heel width of the foot of the wearer is greater than the width of the sole plate 2, the heel counter member 3' is tilted and deformed outwardly and the heel portion of the foot is thus sandwiched and held sideways by the heel counter members 3, 3' (see FIG. 32).

In such a way, the heel of the foot of the shoe wearer can be stably held at all times by the heel counter structure irrespective of width of the heel or size of calcaneus of the foot. On motion as well as in a state of rest, holdability and fittingness of the heel of the foot can be improved.

Eighth Embodiment

In the first and second embodiments, when connecting the heel counter members 3, 3' to the sole plate 2, the connecting portions 30, 30' provided at the lower ends of the heel counter members 3, 3' were used, but application of the present invention is not restricted to these examples.

FIGS. 33 to 37 depict a heel counter structure in accordance with an eighth embodiment of the present invention. In these drawings, like reference numbers indicate identical or functionally similar elements. The eighth embodiment differs from the first and second embodiments in that the heel counter members 3, 3' are connected to the sole plate 2 through connecting portions 21*a*, 22*a* provided at and extending from the peripheral portions 21, 22 of the sole plate 2.

Figure 36:
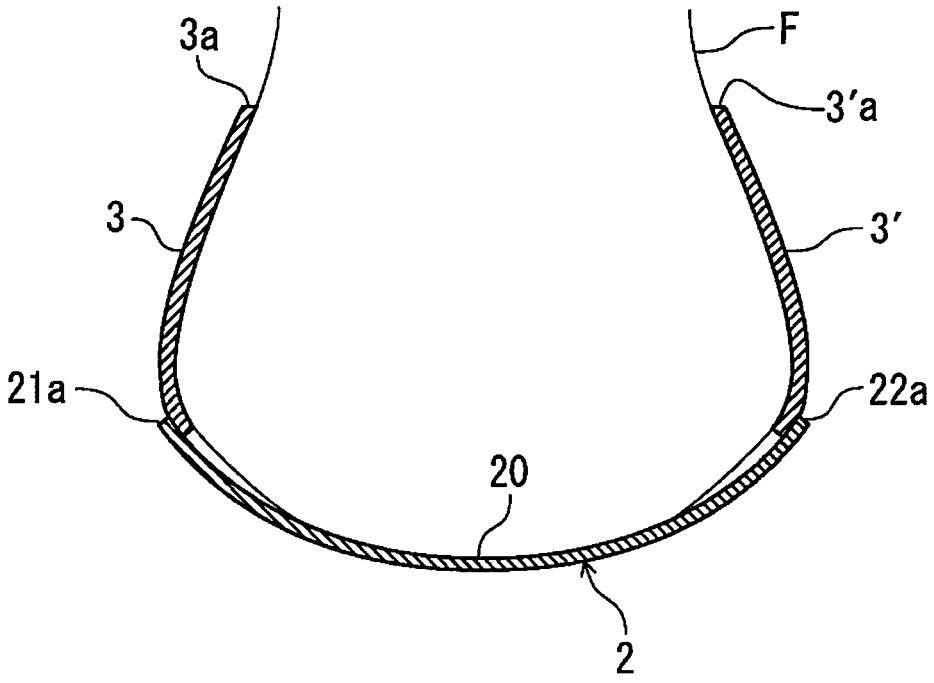
FIG. 36 is a cross sectional view of FIG. 33, illustrating the state in which a heel is held in the structure.
Figure 37:
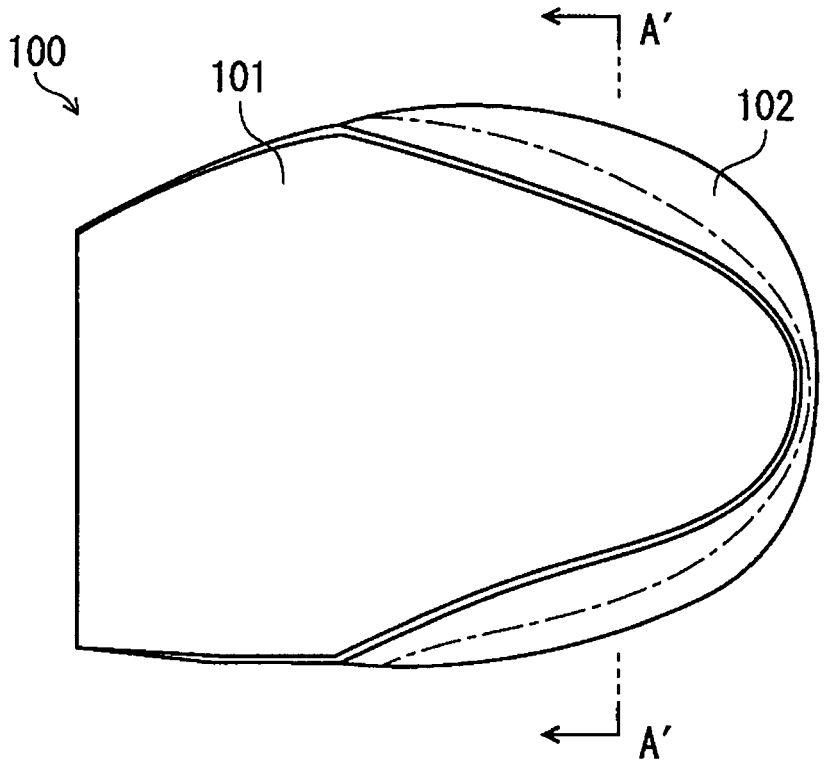
FIG. 37 is a top plan view of a heel counter structure of prior art.
Figure 38:
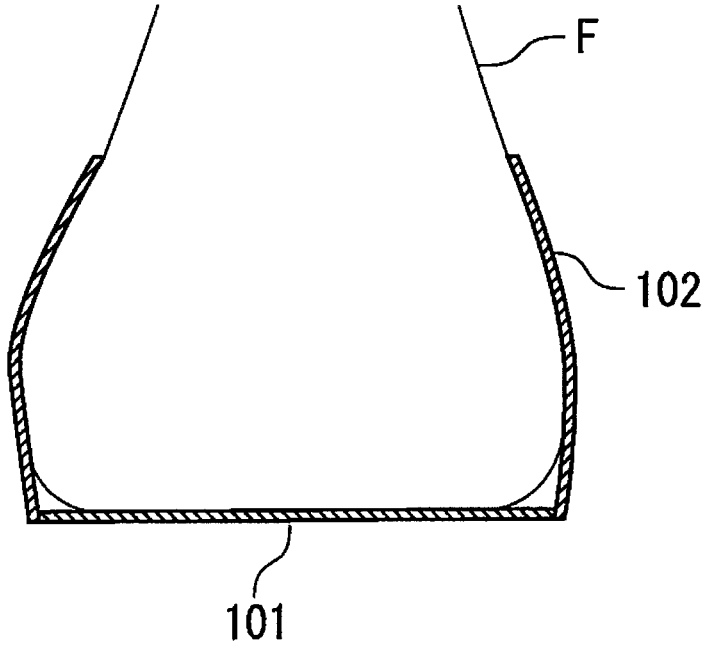
FIG. 38 is a cross sectional view of FIG. 37 taken along line A'-A', illustrating the state in which a foot of a heel width conforming to a heel width of the shoe is held in the structure.
Figure 39:
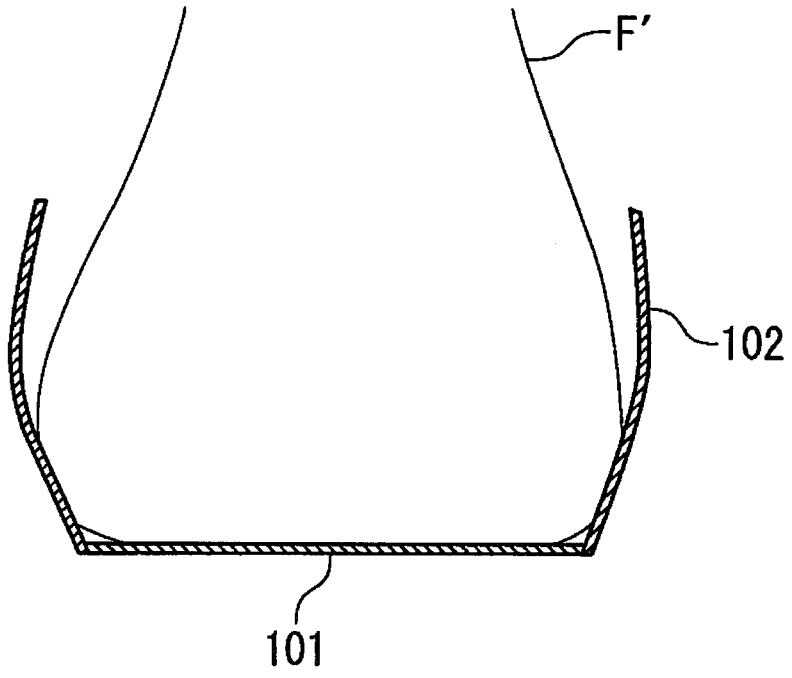
FIG. 39 is a cross sectional view of FIG. 37, taken along line A'-A', illustrating the state in which a heel of a greater width is held in the structure.

In the eighth embodiment as well, when wearing the shoe, the heel lower portion of the foot of the wearer is held by the peripheral portions 21, 22, 23 of the sole plate 2 and the heel portion is sandwiched sideways by the heel counter members 3, 3' connected to the peripheral portions 21, 22 of the sole plate 2 (see FIG. 36). Thereby, the heel portion of the foot can be held and supported and fittingness can be improved.

Also, since the heel counter members 3, 3' are coupled to the connecting portions 21*a*, 22*a* of the peripheral portions 21, 22 of the sole plate 2 such that the heel counter members 3, 3' can be tilted and deformed inwardly and outwardly independent of the sole plate 2, if the heel width of the foot of the wearer is greater than the width of the sole plate 2, the heel counter members 3, 3' are tilted and deformed outwardly and the heel portion of the foot is thus sandwiched and held sideways by the heel counter members 3, 3' (see FIG. 36).

In such a way, the heel of the foot of the shoe wearer can be stably held all the time by the heel counter structure irrespective of width of the heel or size of calcaneus of the foot. On motion as well as in a state of rest, holdability and fittingness of the heel of the foot can be improved.

Additionally, as shown in the eighth embodiment, when the sole plate 2 is disposed outside the heel counter members 3, 3', the sole plate 2 can be exposed outside the upper of the shoe, thus improving decorativeness of the exterior of the shoe by for example, making various designs on the sole plate when resin-molding the sole plate.

To the contrary, when the heel counter members 3, 3' are disposed outside the sole plate 2, if in a manufacturing process of the shoe the heel counter members are assembled as a part of the upper of the shoe through sewing or gluing and the sole plate is disposed as an insole board which the upper enwraps, the insole board does not need to be prepared separately thus simplifying the manufacturing process and making the shoe lightweight.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A heel counter structure for a shoe, said shoe including at least a heel region, said heel counter structure comprising:

a sole plate provided at least at the heel region of the shoe, wherein the sole plate includes a peripheral portion that is upraised along the heel region of the shoe and that is configured to enclose a lower portion of a heel portion of a foot of a shoe wearer; and a pair of heel counter portions provided on a medial side and a lateral side of the heel region of the shoe respectively, wherein said heel counter portions are configured to sandwich the heel portion of the foot sideways, wherein said heel counter portions have lower edges and are tiltably coupled to said peripheral portion of said sole plate along said lower edges, and said heel counter portions are not connected to one another at a rear end of the heel region of the shoe, so that said heel counter portions can tilt laterally and medially, inwardly and outwardly, independently of said sole plate and independently of one another, wherein said heel counter portions are configured to cover respective bulging prominences below a malleolus of the heel portion of the foot on the medial side and the lateral side respectively, and upper edges of said heel counter portions are configured to end below the malleolus, and wherein said peripheral portion of said sole plate on the medial side and the lateral side is respectively configured to be located below and not to cover the respective bulging prominences below the malleolus of the heel portion of the foot.

2. The heel counter structure according to claim 1, wherein said sole plate has a round cupped non-planar shape configured to extend along a shape of a sole of the heel portion of the foot.

3. The heel counter structure according to claim 1, wherein said peripheral portion of said sole plate at the rear end of the heel region of the shoe has an inverted V-shape such that its height is higher at a central portion of said sole plate at the rear end and it gradually lowers toward the medial side and the lateral side.

4. The heel counter structure according to claim 1, wherein said heel counter portions are separated from said peripheral portion of said sole plate except for said lower edge portions of said heel counter portions.

5. The heel counter structure according to claim 3, wherein said central portion having said inverted V-shape of said peripheral portion of said sole plate at the rear end of the heel region of the shoe is configured to extend to or in the vicinity of a most protruded portion of a rear end of the heel portion of the foot.

6. The heel counter structure according to claim 4, wherein starting points of separation of said heel counter portions on rear sides thereof from said peripheral portion of said sole plate are configured to be disposed downward and rearward from the bulging prominences below the malleolus of the heel portion respectively on the medial side and the lateral side.

7. The heel counter structure according to claim 1, wherein said heel counter portions are separated and spaced away from an inverted V-shaped portion of said peripheral portion of said sole plate that extends upwardly between said heel counter portions at the rear end of the heel region.

8. The heel counter structure according to claim 1, wherein either or both of said heel counter portions are formed integrally with said sole plate.

9. The heel counter structure according to claim 1, wherein said heel counter portions are coupled to said peripheral portion of said sole plate via an upper for the shoe that is interposed between said peripheral portion and said heel counter portions.

10. The heel counter structure according to claim 1, wherein each one of said heel counter portions respectively has a longitudinally elongated shape with a curved periphery, selected from an oval shape, a lenticular shape and an egg shape.

11. The heel counter structure according to claim 1, wherein said lower edges of said heel counter portions comprise respective connecting portions that each have a longitudinal length and a thickness less than a longitudinal length and a thickness of a main portion of said respective heel counter portions, such that said connecting portions form bendable hinge members.

12. A heel counter structure for a shoe to be worn on a foot of a person, comprising:

a sole plate provided at least at a heel region of said shoe, wherein said sole plate includes a bottom portion and a peripheral portion that extends upwardly from said bottom portion at a periphery of said sole plate along said heel region;

a medial heel counter and a lateral heel counter respectively provided at a medial side and a lateral side of said heel region;

a medial connection portion connecting a bottom portion of said medial heel counter to a top portion of said peripheral portion of said sole plate on said medial side of said heel region;

a lateral connection portion connecting a bottom portion of said lateral heel counter to a top portion of said peripheral portion of said sole plate on said lateral side of said heel region;

wherein said medial and lateral heel counters are not connected to one another at a rear end of said heel region;

wherein said heel counters are connected to said sole plate only through said connection portions;

wherein said medial and lateral connection portions are configured and constructed to allow said medial and lateral heel counters to tilt inwardly and outwardly independently of one another and independently of said sole plate;

wherein said heel counters are configured and located to cover respective bulging prominences below a malleolus of a heel of the foot of the person on said medial side and said lateral side respectively, and upper edges of said heel counters are configured and located to end below the malleolus;

wherein said peripheral portion of said sole plate on said medial side and said lateral side is configured and located to be below and not to cover the respective bulging prominences; and at least a selected one of said connection portions has at least one of the following features to allow inward and outward tilting of said heel counter connected to said selected connection portion:

said selected connection portion is thinner than said peripheral portion of said sole plate or than said heel counter to which said selected connection portion is connected, or said selected connection portion has a smaller longitudinal length than said heel counter to which said selected connection portion is connected.

13. The heel counter structure for the shoe according to claim 12, wherein said selected connection portion is thinner than said peripheral portion of said sole plate or than said heel counter to which said selected connection portion is connected.

14. The heel counter structure for the shoe according to claim 12, wherein said selected connection portion consists of a material different from said peripheral portion of said sole plate or different from said heel counter to which said selected connection portion is connected.

15. The heel counter structure for the shoe according to claim 12, wherein said selected connection portion has said smaller longitudinal length than said heel counter to which said selected connection portion is connected.

16. The heel counter structure for the shoe according to claim 12, wherein at least one of said connection portions is integral as one piece with said heel counter to which said at least one of said connection portions is integrally connected.

17. The heel counter structure for the shoe according to claim 12, wherein at least one of said connection portions is a discrete separate piece relative to said sole plate, and is connected to said sole plate by at least one of glue or stitching.

18. The heel counter structure for the shoe according to claim 17, wherein said at least one of said connection portions overlaps onto and is connected to an outer surface of said peripheral portion of said sole plate.

19. The heel counter structure for the shoe according to claim 12, wherein at least one of said connection portions is configured as a longitudinal band-shaped strip of material between said peripheral portion of said sole plate and said heel counter to which said connection portion is connected.

* * * * *